US012781452B2

(12) United States Patent
Punk et al.

(10) Patent No.: US 12,781,452 B2
(45) Date of Patent: Nov. 3, 2026

(54) RECONFIGURABLE MATERIAL MOVING ATTACHMENTS

(71) Applicant: Bourgault Machines Inc., St. Brieux (CA)

(72) Inventors: Kevin Punk, St. Brieux (CA); Christopher Griffith, St. Brieux (CA); Kelly Nelson, St. Brieux (CA)

(73) Assignee: Bourgault Machines Inc., St. Brieux (CA)

( * ) Notice: Subject to any disclaimer, the term of this patent is extended or adjusted under 35 U.S.C. 154(b) by 527 days.

(21) Appl. No.: 18/237,844

(22) Filed: Aug. 24, 2023

(65) Prior Publication Data

US 2024/0068188 A1 Feb. 29, 2024

Related U.S. Application Data

(60) Provisional application No. 63/456,366, filed on Mar. 31, 2023, provisional application No. 63/402,301, filed on Aug. 30, 2022.

(51) Int. Cl.

| | |
|---|---|
| ***E01H 5/06*** | (2006.01) |
| ***E02F 3/76*** | (2006.01) |
| ***E02F 3/815*** | (2006.01) |

(52) U.S. Cl.

CPC ..... *E01H 5/061* (2013.01); *E01H 5/068* (2013.01); *E02F 3/7609* (2013.01); *E02F 3/7663* (2013.01); *E02F 3/815* (2013.01)

(58) Field of Classification Search

CPC ..... E01H 5/061; E01H 5/068; E02F 3/7609; E02F 3/7663; E02F 3/815

See application file for complete search history.

(56) References Cited

U.S. PATENT DOCUMENTS

| | | | | |
|---|---|---|---|---|
| 2,710,464 A | | 6/1955 | Husting | |
| 3,115,261 A | * | 12/1963 | Antolini | E02F 3/962 37/405 |
| 3,866,342 A | | 2/1975 | Cooper | |
| 4,189,009 A | | 2/1980 | Welch | |
| 4,356,645 A | | 11/1982 | Hine et al. | |
| 4,521,980 A | | 6/1985 | Solaja | |

(Continued)

FOREIGN PATENT DOCUMENTS

WO 2021087612 A1 5/2021

*Primary Examiner* — Jamie L McGowan

(57) ABSTRACT

A reconfigurable material moving attachment for a vehicle includes a blade having a blade working face directed toward a front of the blade; and a coupling mechanism for reversibly mounting the blade to the vehicle. The coupling mechanism includes a first coupling portion fixed to the blade and a second coupling portion attachable to the vehicle. The second coupling portion is releasably interconnectable with the first coupling portion in: (i) a forward pushing configuration, in which the blade working face is directed away from the vehicle for pushing of the blade during forward operation of the vehicle to collect and push material in a material collection space adjacent the blade working face, and (ii) a back-dragging configuration, in which the blade working face is directed toward the vehicle for pulling of the blade during reverse operation of the vehicle to collect and back drag material in the material collection space.

17 Claims, 19 Drawing Sheets

(56) References Cited

U.S. PATENT DOCUMENTS 4,529,041 A * 7/1985 Black ..... E02F 3/7631 172/445.1
4,545,721 A * 10/1985 Pettersson ..... E02F 3/401 414/607
4,907,357 A * 3/1990 Lilienthal ..... E01H 5/068 172/830
5,265,355 A * 11/1993 Daniels ..... E01H 5/068 37/234
5,497,569 A * 3/1996 Byman ..... E02F 3/815 172/612
5,531,036 A * 7/1996 Shinkle ..... E02F 3/80 37/405
5,819,444 A 10/1998 Desmarais
6,200,083 B1 * 3/2001 Hein ..... B66F 9/19 414/723
6,202,328 B1 * 3/2001 Fulton ..... E01H 5/068 37/231
6,240,660 B1 6/2001 Dugas
6,293,351 B1 * 9/2001 Schmidt ..... E01H 5/068 172/684.5
6,425,196 B1 7/2002 Weagley et al.
6,470,604 B1 10/2002 Foster et al.
6,612,050 B2 9/2003 Takeuchi
6,789,629 B1 * 9/2004 Jones ..... E02F 3/7663 172/708
7,100,314 B1 9/2006 Jensen
7,273,111 B2 * 9/2007 Johnson ..... E02F 3/815 37/231
7,412,787 B2 8/2008 Sutton et al.
7,481,011 B2 1/2009 Nesseth
7,543,401 B2 6/2009 Hughes
7,562,473 B2 7/2009 Westendorf et al.
7,584,557 B1 9/2009 Nistler
7,588,092 B2 9/2009 Liebl
7,658,022 B2 2/2010 Strait
7,661,210 B2 * 2/2010 Shepherd ..... E01H 5/06 37/231
7,743,536 B2 6/2010 Evans et al.
7,779,563 B2 8/2010 Mills
7,941,947 B2 5/2011 Stephan
7,942,209 B1 * 5/2011 Volz ..... E02F 3/8155 172/197
8,191,288 B2 6/2012 Weagley et al.
D684,601 S * 6/2013 Robb, Jr. ..... D15/28
8,621,769 B2 1/2014 Weagley et al.
8,631,596 B2 1/2014 Tulibaski
8,991,079 B2 * 3/2015 Stewart ..... E02F 3/402 37/405
9,243,376 B2 1/2016 Guggino et al.
9,708,784 B2 7/2017 Winter et al.
9,885,160 B1 2/2018 Stone
10,106,942 B2 10/2018 Roberge
10,358,782 B2 7/2019 Holman
10,584,464 B2 * 3/2020 Armstrong ..... E02F 3/8157
10,851,508 B2 * 12/2020 Guggino ..... E01H 5/06
2001/0023546 A1 * 9/2001 Fulton ..... E01H 5/066 37/231
2004/0079539 A1 * 4/2004 Schmidt ..... A01B 59/06 172/439
2006/0059727 A1 3/2006 Yoder
2009/0119954 A1 * 5/2009 Lemieux ..... E02F 3/815 37/236
2012/0017473 A1 * 1/2012 Paonessa ..... E01H 5/062 37/233
2014/0366406 A1 12/2014 Guggino et al.
2016/0194853 A1 * 7/2016 Sawatsky ..... E02F 9/024 172/799.5
2017/0226711 A1 * 8/2017 Roberge ..... E01H 5/067
2017/0362794 A1 12/2017 Heath
2018/0127935 A1 5/2018 Paonessa
2018/0354415 A1 12/2018 Kamimae et al.
2018/0355569 A1 12/2018 Kamimae et al.
2022/0064885 A1 * 3/2022 Niemela ..... E01H 5/062

* cited by examiner

RECONFIGURABLE MATERIAL MOVING ATTACHMENTS

FIELD

The teaching disclosed herein relates to apparatuses and methods for moving material on a ground surface, and more particularly, to reconfigurable material moving attachments.

INTRODUCTION

U.S. Pat. No. 6,470,604 (Foster) discloses a snowplow attachment for mounting to the front end of a vehicle that includes both a push blade operable during forward movement of vehicle and a pull blade operable during reverse movement of the vehicle. The pull blade drops down in front of the push blade such that pushed snow can then be pulled back. The snowplow can get up close to permanent structures such as buildings and remove snow therefrom. During the push mode, the pull blade is raised to avoid interference with pushed snow. The snowplow can include side plates located on the ends of the blades for containing the snow and prevent snow from escaping out the sides, thereby increasing the volume of snow moved by the plow during one sweep. According to one embodiment, the snowplow includes a push blade assembly that is adapted to mount directly on the vehicle and a movable pull blade carried by the push blade assembly. According to another embodiment, separate push blades and pull blades are arranged at separate locations on the attachment such that the entire attachment pivots to alternatively locate one of the blades close to the ground for selecting between pushing or pulling modes.

U.S. Pat. No. 7,941,947 (Stephan) discloses a snow pusher attachment for use in conjunction with a straight blade angle-type snowplow mounted to a work vehicle. According to the patent, the pusher allows a work vehicle to capture, contain, and relocate large amounts of snow very quickly and efficiently. The attachment consists of side panels, connected by horizontal members between. The pusher attachment is secured to the snowplow by bracket assemblies, attached to the upper edge of the snowplow that engage hooks on the upper, rear portion of the pusher attachment. The attachment does not require the operator to exit the work vehicle to secure or release it from the snowplow. According to the patent, the attachment allows the quick and repeated conversion of a snowplow into a snow pusher box and visa versa.

U.S. Pat. No. 10,106,942 (Roberge) discloses a plow blade system adapted for mounting to a vehicle, the blade system having a blade orientable transversally to a longitudinal orientation of movement of the vehicle and having two opposite ends, and two side wall assemblies. Each side wall assembly has a primary sidewall portion mounted to a corresponding end of the blade, the primary sidewall portion extending longitudinally from the corresponding end in a first longitudinal working direction; a sidewall extension slidably mounted to the primary sidewall portion; and a sidewall actuator mounted between the primary sidewall portion and the sidewall extension and operable to selectively slidingly extend the sidewall extension in a second longitudinal working direction opposite to the first longitudinal working direction and retract the sidewall extension within the primary sidewall portion.

PCT Patent Pub. No. WO2021/087612 (Vigneault) discloses a scraper blade device that is adjustable in width and can be used for cleaning a roadway surface. It includes a main transversal support and an elongated moldboard. The moldboard includes two partially overlapping elongated moldboard units. The scraper blade device also includes a plurality of blade segments that can be tilted with reference to one another to follow profile variations of the roadway surface. According to Vigneault, this allows the efficiency of the cleaning to be preserved even when the scraper blade device becomes very large when fully extended.

U.S. Pat. No. 4,189,009 (Welch) discloses a wheel mounted earth moving scraper for towing behind a tractor or the like. The scraper is mounted on a wheel axle. The scraper is characterized by a scraper housing attached to a pivot axle which is pivotally attached to the wheel axle for pivoting the scraper housing transverse to the direction of travel of the scraper so that as the wheels mounted on the wheel axle travel on the ground surface, the scraper housing may be tilted independently of the wheels.

SUMMARY

The following summary is intended to introduce the reader to various aspects of the applicant's teaching, but not to define any invention.

According to some aspects, a reconfigurable material moving attachment for a vehicle includes: (a) a blade having a blade working face directed toward a front of the blade and extending in a lateral direction between opposed side plates. Each side plate projects forward of the blade working face. The side plates have inboard surfaces directed towards one another for laterally enclosing a material collection space adjacent the blade working face. The attachment further includes (b) a coupling mechanism for reversibly mounting the blade to the vehicle. The coupling mechanism includes a first coupling portion fixed to the blade and a second coupling portion mountable to the vehicle. The second coupling portion is releasably interconnectable with the first coupling portion in: (i) a forward pushing configuration, in which the blade working face is directed away from the vehicle for pushing of the blade during forward operation of the vehicle to collect and push material in the material collection space, and (ii) a back-dragging configuration, in which the blade working face is directed toward the vehicle for pulling of the blade during reverse operation of the vehicle to collect and back drag material in the material collection space.

In some examples, the first and second coupling portions are releasably interconnectable by movement of the second coupling portion relative to the first coupling portion along a coupling axis. The coupling axis is generally parallel to a ground surface supporting the material and orthogonal to the lateral direction.

In some examples, the first coupling portion includes at least one coupling channel extending parallel to the coupling axis between a channel front end and a channel rear end axially opposite the channel front end. The channel front end is open to the front of the blade for interconnection of the second coupling portion from the front to mount the blade to the vehicle in the back-dragging configuration. The channel rear end is open to a rear of the blade for interconnection of the second coupling portion from the rear to mount the blade to the vehicle in the pushing configuration.

In some examples, the second coupling portion includes at least one arm projecting forward from the vehicle. The arm is alignable parallel with the coupling axis and slidably receivable in the coupling channel from the channel rear end for interconnection in the pushing configuration and from the channel front end for interconnection in the back-dragging configuration.

In some examples, the coupling mechanism includes a locking mechanism for axially locking the first and second coupling portions relative to each other when interconnected.

In some examples, the locking mechanism includes a locking member moveably coupled to one of the first and second coupling portions. When the first and second coupling portions are interconnected, the locking member is movable relative to an abutment structure fixed to the other one of the first and second coupling portions, between a locked position for interlocking engagement with the abutment structure to axially lock the first and second coupling portions relative to each other, and an unlocked position clear of the abutment structure.

In some examples, the locking member includes at least one finger with a locking notch, the locking notch clear of the abutment structure when the locking member is in the unlocked position, and the locking notch receiving at least a portion of the abutment structure when the locking member is in the locked position.

In some examples, the abutment structure includes at least one retaining bar extending in the lateral direction and receivable in the notch when the locking member is in the locked position.

In some examples, the abutment structure is fixed to the first coupling portion of the coupling mechanism and the locking member is movably coupled to the second coupling portion of the coupling mechanism.

In some examples, the second coupling portion includes an isolation bar extending parallel to the at least one retaining bar, and the finger of the locking member has a force transfer notch spaced apart from the locking notch. The force transfer notch receives the isolation bar when the locking member is in the locked position to facilitate transfer of horizontal reaction forces from the first coupling portion of the coupling mechanism to the second coupling portion through the isolation bar.

In some examples, the abutment structure includes a pair of the retaining bars including a first retaining bar positioned toward the front of the blade and a second retaining bar spaced apart from the first retaining bar along the coupling axis toward a rear of the blade. The locking notch receives the first retaining bar and is clear of the second retaining bar when the locking member is in the locked position and the first and second coupling portions are interconnected in the back-dragging configuration. The locking notch receives the second retaining bar and is clear of the first retaining bar when the locking member is in the locked position and the first and second coupling portions are interconnected in the pushing configuration.

In some examples, the locking mechanism includes an actuator assembly including at least one actuator energizable for urging movement of the locking member between the locked and unlocked positions. In some examples, the actuator assembly includes a return device coupled to the locking member for biasing the locking member toward the locked position. In some examples, the at least one actuator is remotely operable from within a cab of the vehicle. In some examples, the at least one actuator includes a hydraulic cylinder.

In some examples, each side plate is immovably fixed relative to the blade working face.

According to some aspects, a reconfigurable material moving attachment for a vehicle includes (a) a blade having a blade working face; and (b) a coupling mechanism for reversibly mounting the blade to a vehicle. The coupling mechanism includes a first coupling portion fixed to the blade and a second coupling portion mountable to the vehicle. The second coupling portion is releasably interconnectable with the first coupling portion in a forward pushing configuration, in which the blade working face is directed away from the vehicle for pushing the material forward, and a back-dragging configuration, in which the blade working face is directed toward the vehicle for back dragging the material.

According to some aspects, a coupling mechanism for reversibly mounting a material moving blade to a vehicle includes: (a) a first coupling portion fixable to the blade, the blade having a blade working face; and (b) a second coupling portion mountable to the vehicle, the second coupling portion releasably interconnectable with the first coupling portion in: (i) a pushing configuration, in which the blade working face is directed away from the vehicle for pushing of the blade during forward operation of the vehicle to collect and push material with the blade working face, and (ii) a back-dragging configuration, in which the blade working face is directed toward the vehicle for pulling of the blade during reverse operation of the vehicle to collect and back drag material with the blade working face.

According to some aspects, a method of moving material includes: (a) mounting a blade to a vehicle in a pushing configuration, in which a working face of the blade is directed away from the vehicle; (b) when the blade is in the pushing configuration, pushing material with the working face of the blade during forward operation of the vehicle; (c) after (b), releasing the blade from the vehicle and then mounting the blade to the vehicle in a back-dragging configuration, in which the working face of the blade is directed toward the vehicle; and (d) when the blade is in the back-dragging configuration, back-dragging material with the working face of the blade during reverse operation of the vehicle.

In some examples, the mounting in (a) includes driving the vehicle forward toward a rear of the blade opposite the working face to interconnect first and second coupling portions of a coupling mechanism, the first coupling portion fixed to the blade and the second coupling portion attached to the vehicle.

In some examples, the releasing in (c) includes reversing the vehicle away from the rear of the blade to disconnect the first and second coupling portions, and the mounting in (c) includes driving the vehicle forward toward the working face of the blade to interconnect the first and second coupling portions of the coupling mechanism.

In some examples, the mounting in (a) and (c) includes remotely operating a lock actuator to lock the first and second coupling portions relative to each other when interconnected, and the releasing in (c) includes remotely operating the lock actuator to unlock the first and second coupling portions relative to each other.

In some examples, the method further includes: (e) mounting the blade to the same or a different vehicle in a towing configuration, in which the blade is behind the vehicle with the working face of the blade directed toward the vehicle; and (f) when the blade is in the towing configuration, dragging the blade along a ground surface during forward operation of the vehicle.

According to some aspects, a reconfigurable material moving attachment for a vehicle includes: (a) a blade having a blade working face directed toward a front of the blade and extending in a lateral direction between opposed side plates. Each side plate projects forward of the blade working face. The side plates have inboard surfaces directed towards one another for laterally enclosing a material collection space adjacent the blade working face. The attachment further includes (b) a coupling mechanism for attaching the blade to the vehicle. The coupling mechanism includes: (i) a first coupling portion fixed to the blade and having at least one coupling channel extending along a coupling axis. The coupling axis is generally parallel to a ground surface and orthogonal to the lateral direction. The coupling mechanism further includes (ii) a second coupling portion attachable to the vehicle. The second coupling portion has at least one arm alignable parallel with the coupling axis. Each arm is slidably receivable in a respective coupling channel to releasably interconnect the first and second coupling portions for attachment of the blade to the vehicle.

In some examples, each coupling channel extends between a channel front end open to the front of the blade and a channel rear end axially opposite the channel front end and open to a rear of the blade.

In some examples, the second coupling portion includes a vehicle mount opposite the at least one arm for mounting the second coupling portion to the vehicle with the at least one arm projecting away from the vehicle.

In some examples, each arm is slidably receivable into a respective coupling channel from: (i) the channel rear end to mount the blade to the vehicle in a forward pushing configuration, in which the blade working face is directed away from the vehicle for pushing material in the material collection space, and (ii) the channel front end to mount the blade to the vehicle in a back-dragging configuration, in which the blade working face is directed toward the vehicle for back-dragging material in the material collection space.

In some examples, the second coupling portion includes a trailer frame for attaching the blade behind the vehicle in a towing configuration, in which the blade working face is directed toward the vehicle for dragging the blade along the ground surface behind the vehicle.

In some examples, the trailer frame has a rear end supported above a ground surface by a plurality of wheel assemblies and the at least one arm projects forward of the wheel assemblies toward the vehicle, each arm slidably receivable into a respective coupling channel from the channel rear end to mount the blade in the towing configuration.

According to some aspects, a box blade assembly for vehicles includes: (a) a box blade having a blade working face directed toward a front of the blade and extending in a lateral direction between opposed side plates. Each side plate projects forward of the blade working face. The side plates have inboard surfaces directed towards each other for laterally enclosing a material collection space adjacent the blade working face. The box blade assembly further includes (b) a first coupling portion fixed to the blade and having at least one coupling channel extending along a coupling axis. The coupling axis is generally parallel to a ground surface and orthogonal to the lateral direction. The first coupling portion is releasably interconnectable with a second coupling portion attachable to a vehicle. The second coupling portion has at least one arm alignable parallel with the coupling axis. Each arm is slidably receivable in a respective coupling channel to releasably interconnect the first and second coupling portions for attaching the box blade to the vehicle.

In some examples, each coupling channel extends between a channel front end open to the front of the blade and a channel rear end axially opposite the channel front end and open to a rear of the blade.

In some examples, the at least one coupling channel extends through the blade working face.

In some examples, the at least one coupling channel includes a pair of coupling channels spaced laterally apart from each other for receiving respective arms of the second coupling portion.

According to some aspects, a trailer assembly for towing a box blade behind a vehicle includes: (a) a trailer frame extending along a trailer frame axis between a trailer frame rear end and a trailer frame front end axially opposite the trailer frame rear end. The trailer frame rear end is supported above a ground surface by a plurality of wheel assemblies. The trailer frame front end has at least one arm projecting forward of the wheel assemblies along the trailer frame axis. Each arm is slidable through a respective coupling channel fixed to the box blade for mounting the box blade to the trailer frame with a working face of the box blade directed away from the wheel assemblies toward the vehicle. The trailer assembly further includes (b) a tongue frame extending along a tongue frame axis between a tongue frame front end and a tongue frame rear end axially opposite the tongue frame front end. The tongue frame front end has a hitch coupler for connection to a hitch of the vehicle. The tongue frame rear end is attachable to the at least one arm of the trailer frame for attaching the trailer frame to the vehicle and detachable from the at least one arm to permit sliding of the box blade on to and off from the at least one arm.

In some examples, when the tongue frame rear end is attached to the at least one arm with the box blade mounted, the box blade is held axially captive between a first abutment surface fixed to the trailer frame behind the blade working face and a second abutment surface fixed to the tongue frame ahead of the blade working face.

In some examples, each arm includes a slot open upwardly for receiving a respective pin fixed to the tongue frame rear end to connect the tongue frame to the trailer frame.

In some examples, when received in the slot, the pin extends laterally along a pin axis about which the tongue frame is pivotable relative to the trailer frame between an initial coupling position and an operating position. In the initial coupling position, the second abutment surface is spaced axially forward of a front engagement surface fixed to the box blade to permit interference-free sliding of the pin into and out from the slot. In the operating position, the second abutment surface is moved rearward relative to the initial coupling position for engagement with the front engagement surface to retain the blade in position between the first and second abutment surfaces.

In some examples, the tongue frame rear end has one or more tongue frame apertures extending therethrough parallel with and adjacent the pin axis, and the at least one arm includes one or more corresponding arm apertures extending therethrough parallel with the pin axis. Each tongue frame aperture is brought into alignment with a respective arm aperture when the tongue frame is moved into the operating position for receiving a respective fastener to secure the tongue frame to the trailer frame in the operating position.

In some examples, the tongue frame projects forward of the trailer frame when in the initial coupling position and in the operating position, and the tongue frame is further pivotable about the pin axis to a storage position in which the tongue frame extends overtop of the trailer frame to reduce a footprint of the trailer assembly.

In some examples, the trailer frame has a height adjustment mechanism operable to raise and lower the at least one arm relative to the wheel assemblies for adjusting elevation of the box blade relative to the ground surface.

In some examples, the trailer frame has a tilt-adjustment mechanism operable to pivot the at least one arm about a tilt axis relative to the wheel assemblies to adjust a tilt of the box blade relative to the ground surface. the tilt axis extending generally parallel with the trailer frame axis.

In some examples, the at least one arm includes a pair of arms spaced laterally apart from each other, and the at least one coupling channel includes a pair of coupling channels, each coupling channel for slidably receiving a respective arm.

DRAWINGS

For a better understanding of the described examples and to show more clearly how they may be carried into effect, reference will now be made, by way of example, to the accompanying drawings in which.

The drawings included herewith are for illustrating various examples of apparatuses and methods of the teaching of the present specification and are not intended to limit the scope of what is taught in any way.

DESCRIPTION OF VARIOUS EXAMPLES

Various apparatuses or processes will be described below to provide an example of each claimed invention. No example described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an example of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Moving granular material (e.g. snow, soil, gravel, etc.) can involve mounting a blade to a vehicle (e.g. loader, tractor, truck, etc.) and pushing the material forward with the blade during forward operation of the vehicle (e.g. by driving the vehicle forward or advancing a boom or arm of the vehicle forward). In some situations, some of the material may lie adjacent a structure (e.g. wall, garage door, etc.) in the area being cleared of the material, and the vehicle may be unable to drive parallel to the structure to push the adjacent material. In such situations, it can be desirable to back drag the material away from the structure with the blade by pulling the blade during reverse operation of the vehicle (e.g. by driving the vehicle in reverse or retracting a boom or arm of the vehicle).

Some existing material moving systems capable of switching between pushing and back dragging modes can be overly complex and costly. Some can also suffer from notable disadvantages for the back dragging mode. These disadvantages can include, for example, requiring use of a rear surface of the blade that lacks preferred curvature for material movement, the inability to stop material from easily spilling out from the sides, obstruction of the operator's view making it difficult to determine proper blade positioning and clearance from structures, and/or requiring the operator to exit the vehicle to switch modes.

According to some aspects of the present disclosure, a reconfigurable material moving attachment is disclosed that can help address some of the shortcomings of existing material moving systems, and provide for reduced cost and complexity relative to some existing systems.

Figure 1:
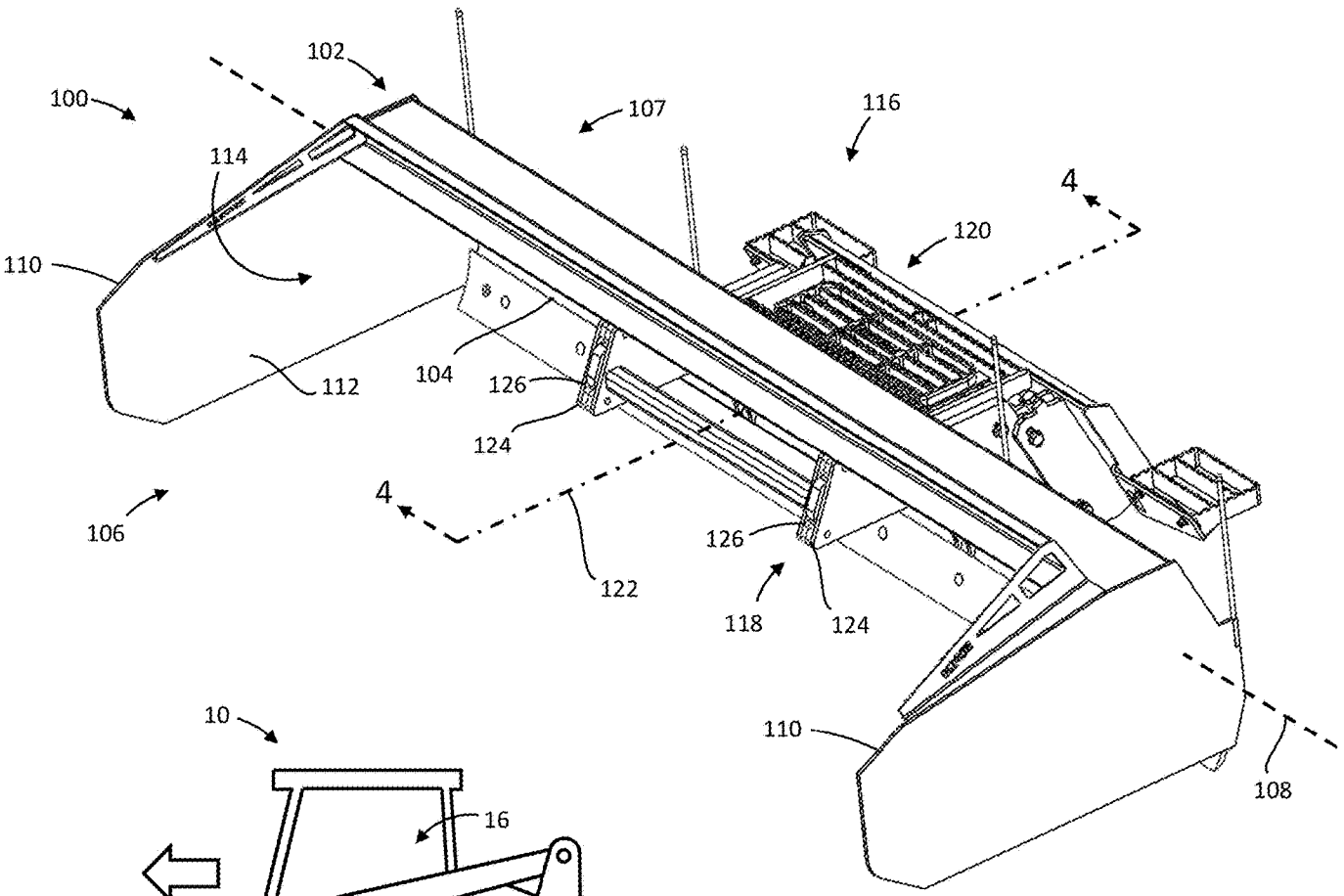
FIG. 1 is a front perspective view of an example reconfigurable material moving attachment with a blade of the attachment in a forward pushing configuration.
Figure 2:
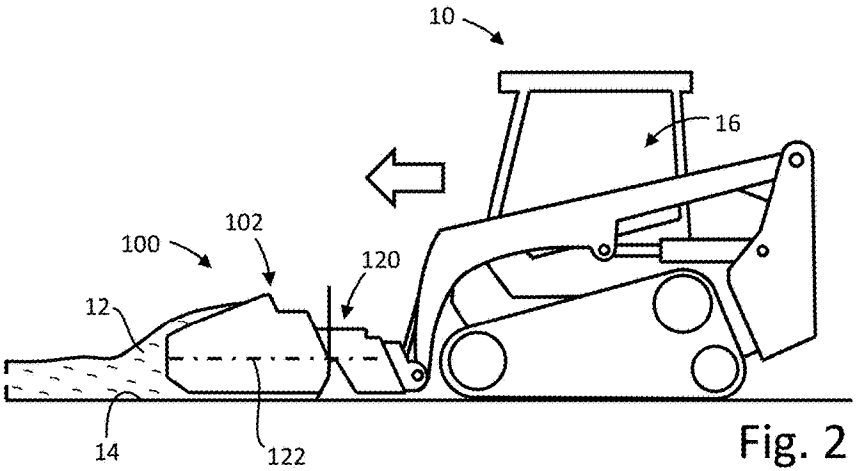
FIG. 2 is a side elevation schematic showing the attachment of FIG. 1 mounted to an example vehicle.

Referring to FIGS. 1 and 2, an example of a reconfigurable material moving attachment 100 for a vehicle 10 is illustrated. The attachment 100 includes a blade 102 having a central body with a blade working face 104 directed generally toward a front 106 of the blade 102. In the example illustrated, the blade 102 further includes a pair of opposed side plates 110, and the blade working face 104 extends in a lateral direction 108 between the opposed side plates 110. Each side plate 110 projects forward of the blade working face 104. The side plates 110 have corresponding inboard surfaces 112 directed towards one another for laterally enclosing a material collection space 114 adjacent the blade working face 104. In the example illustrated, the side plates 110 are optionally immovably fixed relative to the blade working face 104.

Figure 6:
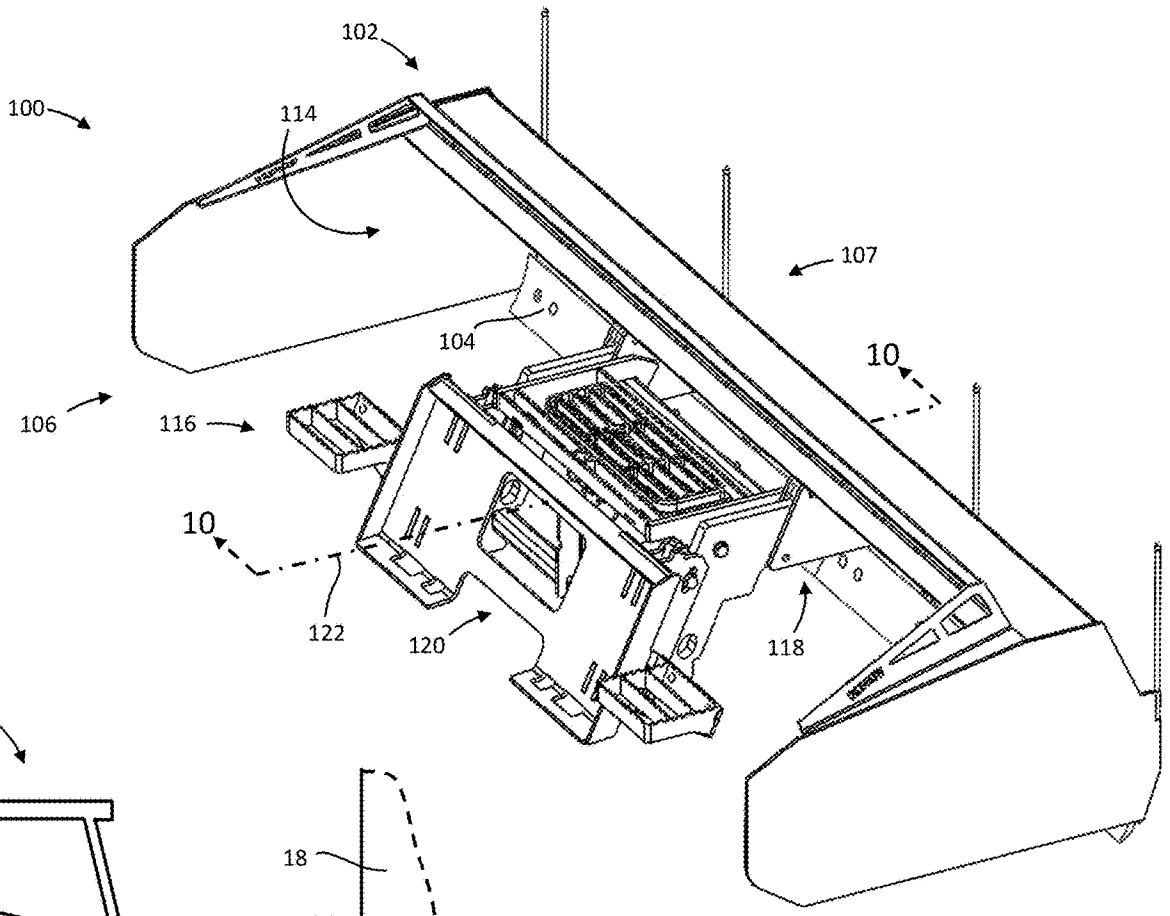
FIG. 6 is a front perspective view of the attachment of FIG. 1 with the blade in a back dragging configuration.
Figure 7:
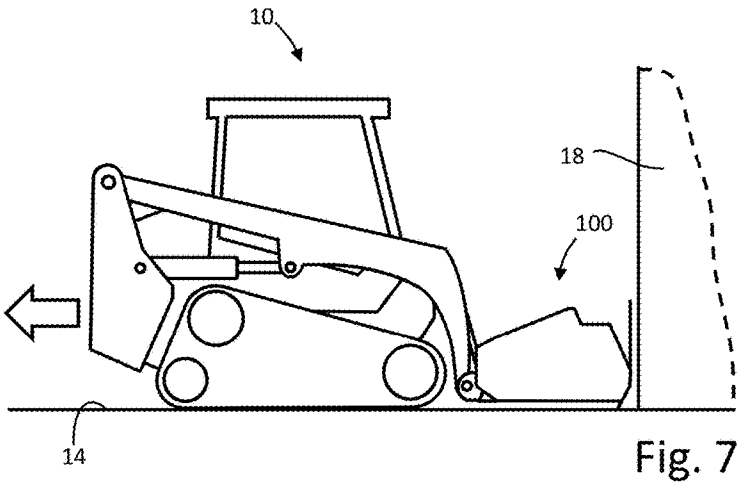
FIG. 7 is a side elevation schematic showing the attachment of FIG. 6 mounted to the vehicle.

In the example illustrated, the attachment 100 further includes a coupling mechanism 116 for reversibly mounting the blade 102 to the vehicle 10. In the example illustrated, the coupling mechanism 116 has a first coupling portion 118 fixed to the blade 102 and a second coupling portion 120 mountable to the vehicle 10. The second coupling portion 120 is releasably interconnectable with the first coupling portion 118 in a forward pushing configuration (shown in FIG. 1) and a back-dragging configuration (shown in FIG. 6). Referring to FIGS. 1 and 2, in the pushing configuration, the blade working face 104 is directed away from the vehicle 10 for pushing of the blade 102 during forward operation of the vehicle to collect and push material 12 in the material collection space 114. Referring to FIGS. 6 and 7, in the back-dragging configuration, the blade working face 104 is directed toward the vehicle for pulling of the blade 102 during reverse operation of the vehicle 10 to collect and back drag material in the material collection space 114, and away from, for example, an adjacent structure 18 such as a building wall or garage door.

Figure 3:
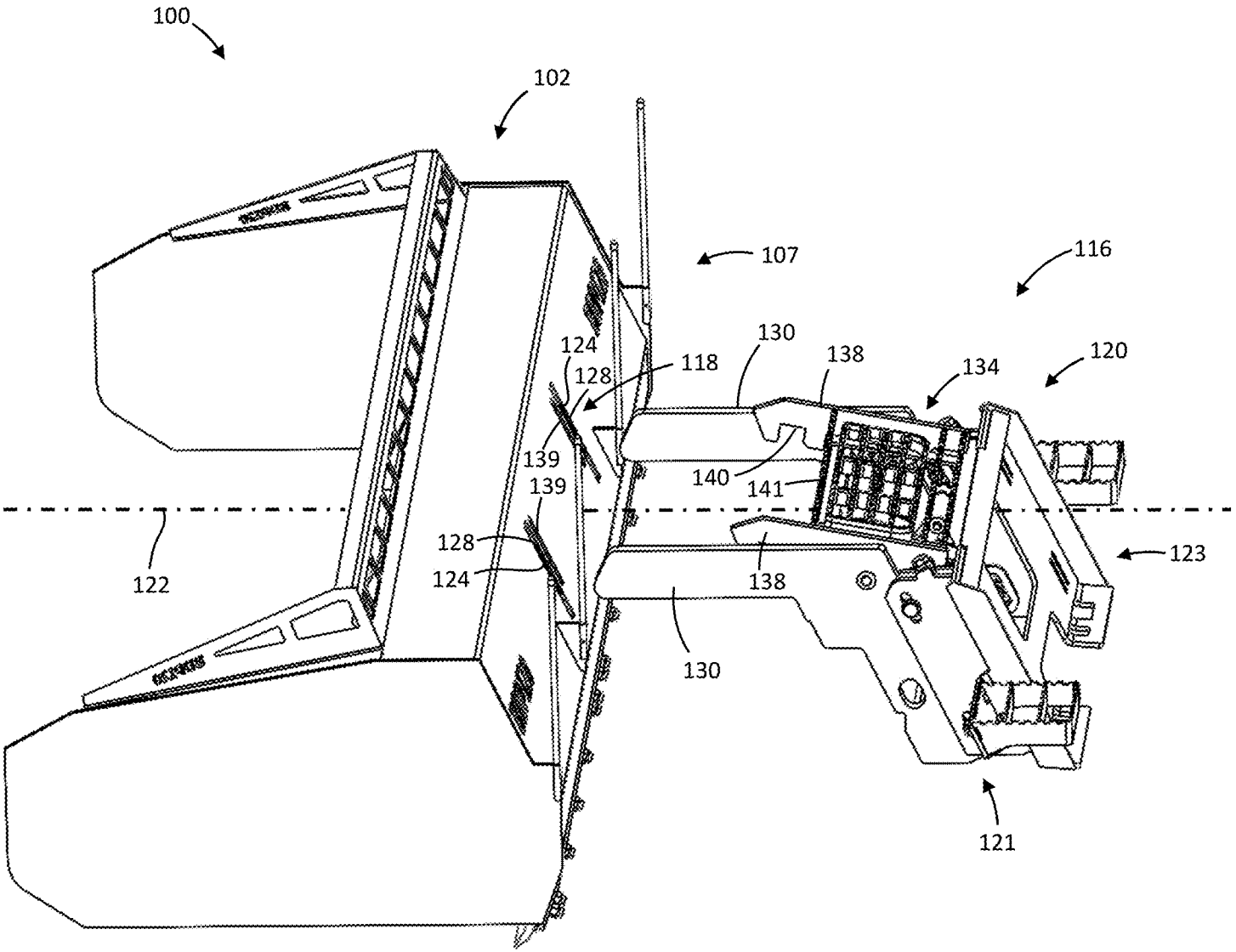
FIG. 3 is a side perspective view of the attachment of FIG. 1 with first and second coupling portions of a coupling mechanism of the attachment shown disconnected.

Referring to FIG. 3, in the example illustrated, the first and second coupling portions 118, 120 are releasably interconnectable by movement of the second coupling portion 120 relative to the first coupling portion 118 along a coupling axis 122. Referring to FIGS. 1 and 2, in the example illustrated, the coupling axis 122 is generally parallel to a ground surface 14 supporting the material 12 and orthogonal to the lateral direction 108.

Figure 8:
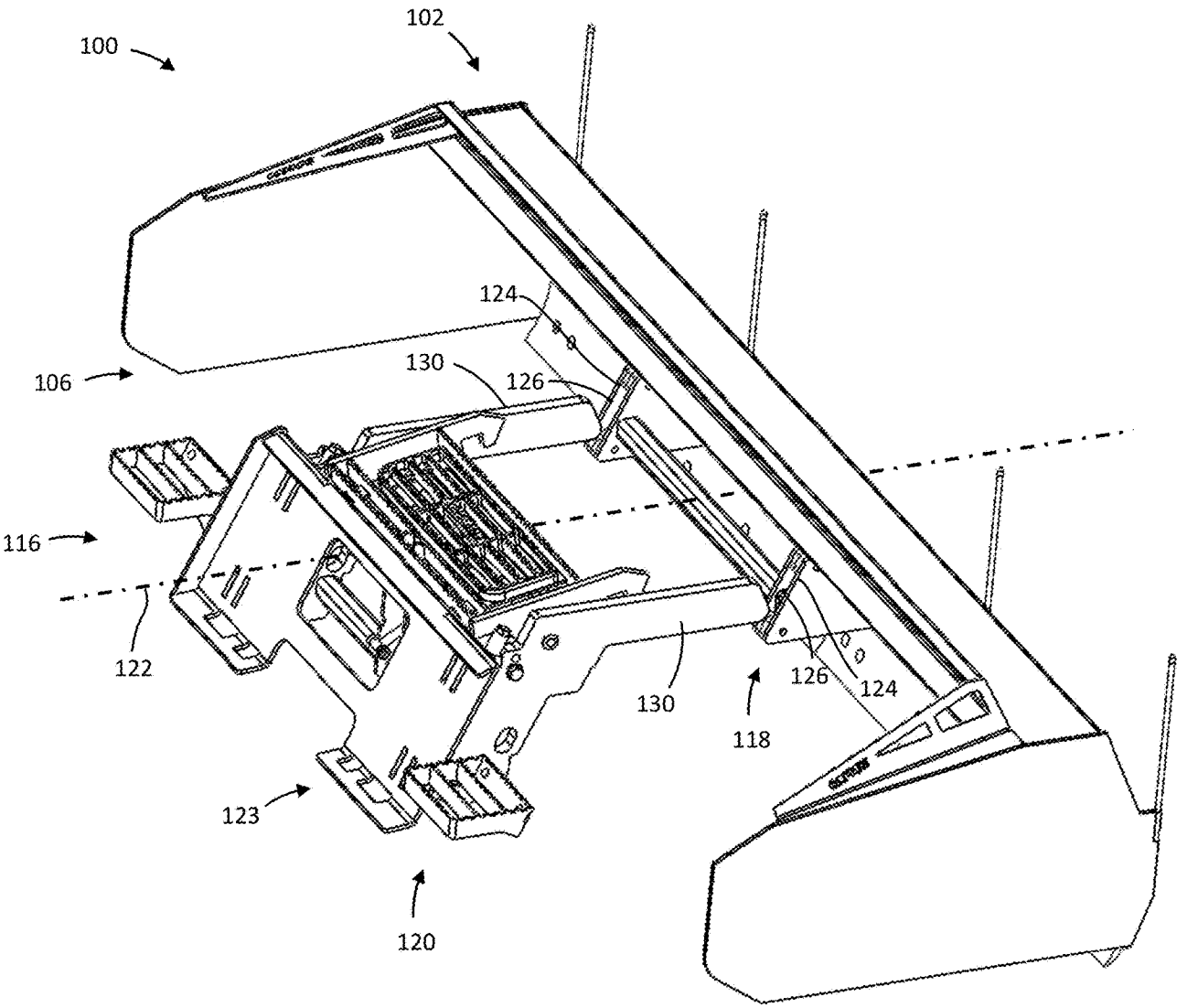
FIG. 8 is another front perspective view of the attachment of FIG. 6, with the first and second coupling portions of the coupling mechanism shown disconnected.

Referring to FIG. 1, in the example illustrated, the first coupling portion 118 comprises at least one coupling channel 124 extending parallel to the coupling axis 122. The coupling channel 124 extends between a channel front end 126 and a channel rear end 128 (FIG. 3) axially opposite the channel front end 126. Referring to FIG. 3, in the example illustrated, the channel rear end 128 is open to a rear 107 of the blade 102 for interconnection of the second coupling portion 120 from the rear 107 to mount the blade 102 to the vehicle 10 in the pushing configuration. Referring to FIG. 8, the channel front end 126 is open to the front 106 of the blade 102 for interconnection of the second coupling portion 120 from the front 106 to mount the blade 102 to the vehicle 10 in the back-dragging configuration. In the example illustrated, the first coupling portion 118 comprises a pair of the coupling channels 124. The coupling channels 124 are spaced laterally apart from each other by a channel spacing.

In the example illustrated, the second coupling portion 120 comprises at least one arm 130 projecting forward from the vehicle 10 when the second coupling portion 120 is mounted to the vehicle 10. In the example illustrated, the second coupling portion 120 comprises a pair of the arms 130. The arms 130 are spaced laterally apart from each other by an arm spacing corresponding to the channel spacing for lateral alignment of the arms with the coupling channels 124. In the example illustrated, the arms are alignable parallel with the coupling axis 122 (and corresponding coupling channels 124), and each arm 130 is slidably receivable in a corresponding coupling channel 124 for interconnection with the first coupling portion 118. In the example illustrated, the arms 130 are slidable into corresponding channels 124 from the channel front end 126 for interconnection in the back-dragging configuration. Referring to FIG. 3, in the example illustrated, the arms 130 are slidable into corresponding channels 124 from the channel rear end 128 for interconnection in the pushing configuration.

In the example illustrated, the second coupling portion 120 includes a frame 121 to which the arms 130 are affixed. The second coupling portion 120 further includes a vehicle mount 123 attached to the frame 121 opposite the arms 130 and directed toward the vehicle 10. The vehicle mount 123 is for attachment to the vehicle (e.g. to a loader arm, boom, mounting frame, etc.) to secure the second coupling portion 120 to the vehicle 10.

Figure 4:
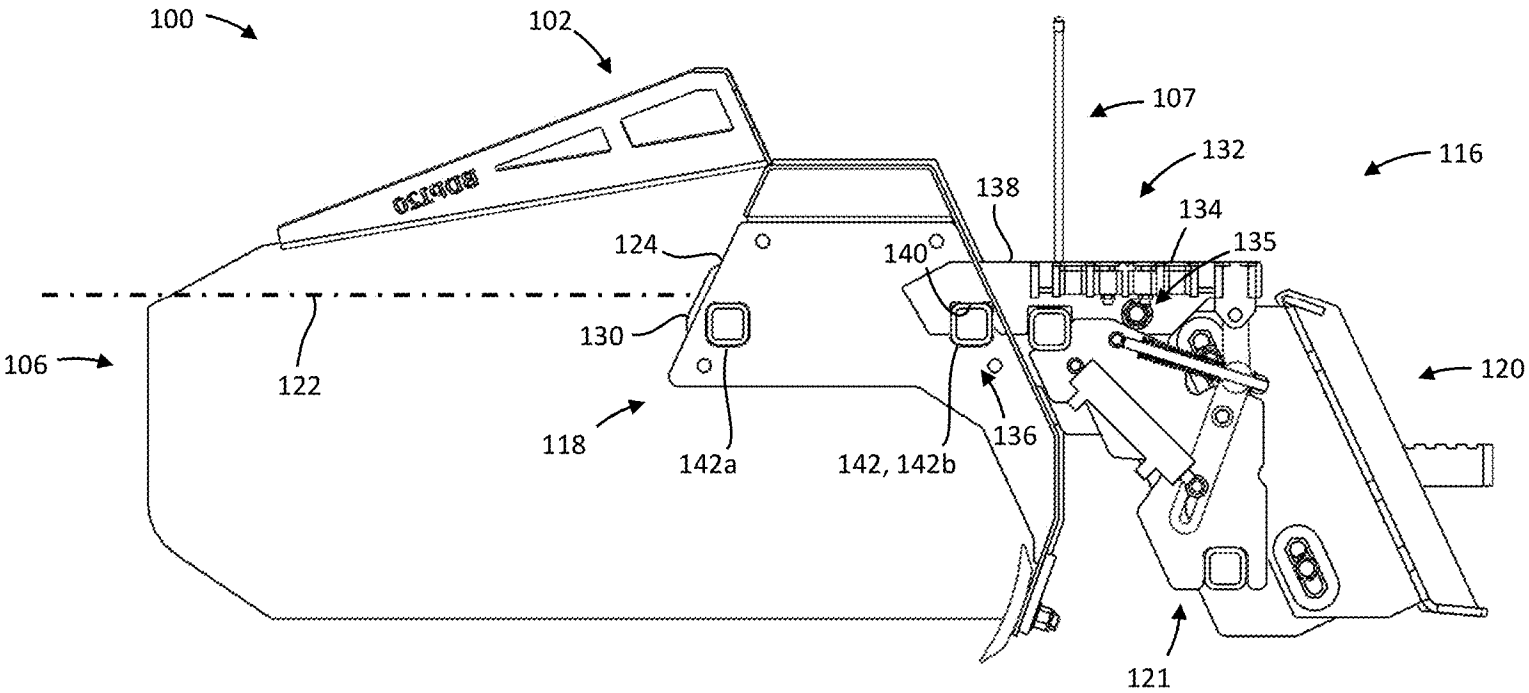
FIG. 4 is a cross-sectional view of the attachment of FIG. 1, taken along line 4-4 of FIG. 1.

Referring to FIG. 4, in the example illustrated, the coupling mechanism 116 includes a locking mechanism 132 for axially locking the first and second coupling portions 118, 120 relative to each other when interconnected. The locking mechanism 132 includes a locking member 134 moveably coupled to one of the first and second coupling portions 118, 120 for interlocking engagement with an abutment structure 136 fixed to the other one of the first and second coupling portion 118, 120. In the example illustrated, the locking member 134 is movably coupled to the frame 121 of the second coupling portion 120 and the abutment structure 136 is fixed to the first coupling portion 118 of the coupling mechanism 116. In the example illustrated, the abutment structure 136 is laterally intermediate the pair of coupling channels 124, and the locking member 134 is laterally intermediate the arms 130. In the example illustrated, the locking member 134 is pivotably coupled to the frame 121 of the second coupling portion 120 through a pivot connection 135 for pivoting between locked and unlocked positions about a pivot axis extending parallel to the lateral direction 108.

Figure 5B:
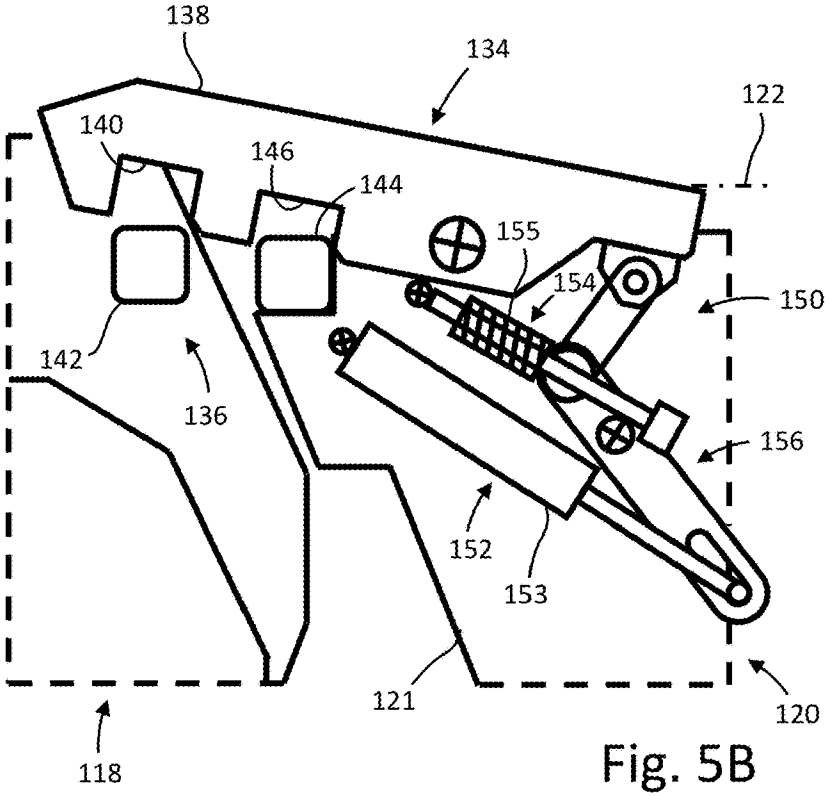
FIG. 5B is a schematic like that of FIG. 5A, but showing the locking mechanism in an unlocked configuration.
Figure 5A:
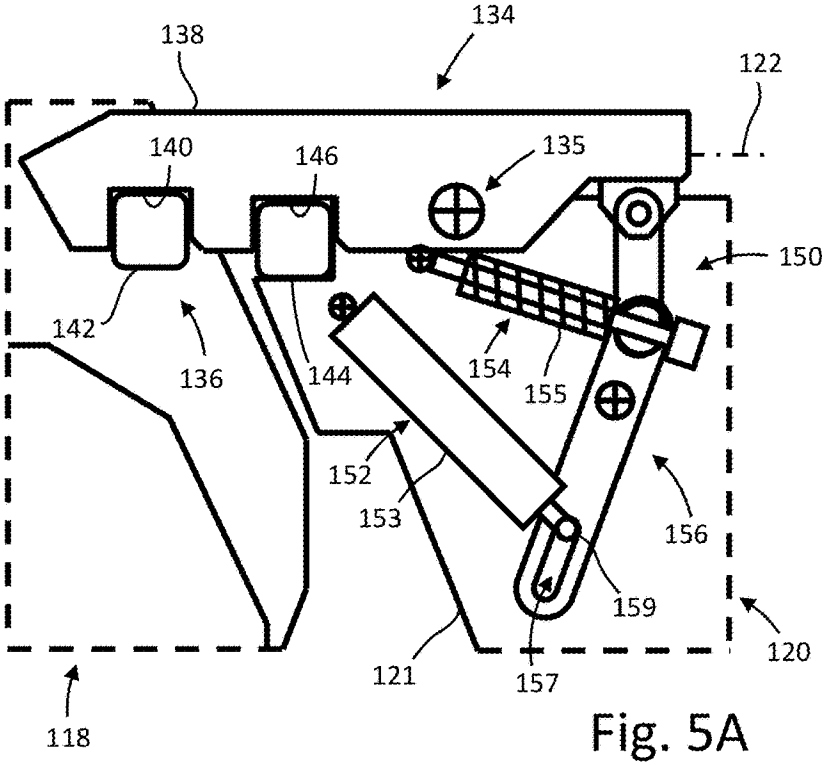
FIG. 5A is an enlarged cross-sectional schematic of a locking mechanism of the attachment of FIG. 4, shown in a locked configuration.

Referring to FIGS. 5A and 5B, in the example illustrated, when the first and second coupling portions 118, 120 are interconnected, the locking member 134 is movable relative to the abutment structure 136 between a locked position (FIG. 5A) and an unlocked position (FIG. 5B). Referring to FIG. 5A, when in the locked position, the locking member 134 is in interlocking engagement with the abutment structure 136 to axially lock the first and second coupling portions 118, 120 relative to each other along the coupling axis 122 (thereby fixing the arms 130 in axial position within the coupling channels 124). Referring to FIG. 5B, when in the unlocked position, the locking member 134 is clear of the abutment structure 136 to permit axial movement of the first and second coupling portions 118, 120 relative to each other along the coupling axis 122 (and sliding of the arms 130 within the coupling channels 124) for disconnection and reconnection of the first and second coupling portions 118, 120.

In the example illustrated, the locking member 134 comprises at least one finger 138 with a locking notch 140. The locking notch 140 is clear of the abutment structure 136 when the locking member 134 is in the unlocked position. Referring to FIG. 5A, the locking notch 140 receives at least a portion of the abutment structure 136 when the locking member 134 is in the locked position. In the example illustrated, the locking notch 140 is on an underside of the finger 138. When the locking member 134 is moved to the locked position, the finger 138 moves downwardly such that the locking notch 140 receives the abutment structure 136 in interlocking engagement. Referring to FIG. 3, in the example illustrated, the locking member 134 has a pair of the fingers 138 spaced laterally apart from each other, with each finger 138 having a corresponding locking notch 140. In the example illustrated, the locking member 134 has a locking member frame 141 extending laterally between the pair of fingers 138 and fixing the fingers 138 relative to each other for movement in unison between the locked and unlocked positions. In the example illustrated, a pair of apertures 139 (see also FIG. 9) extend through the blade 102 along the coupling axis 122. The apertures 139 receive the fingers 138 for engagement with the abutment structure 136 when the arms 130 are inserted into the coupling channels 124 from the rear 107 for interconnecting the first and second coupling portions 118, 120 in the pushing configuration. In the example illustrated, the apertures 139 are laterally inboard of the adjacent channel rear ends 128 of the coupling channels 124.

Figure 10:
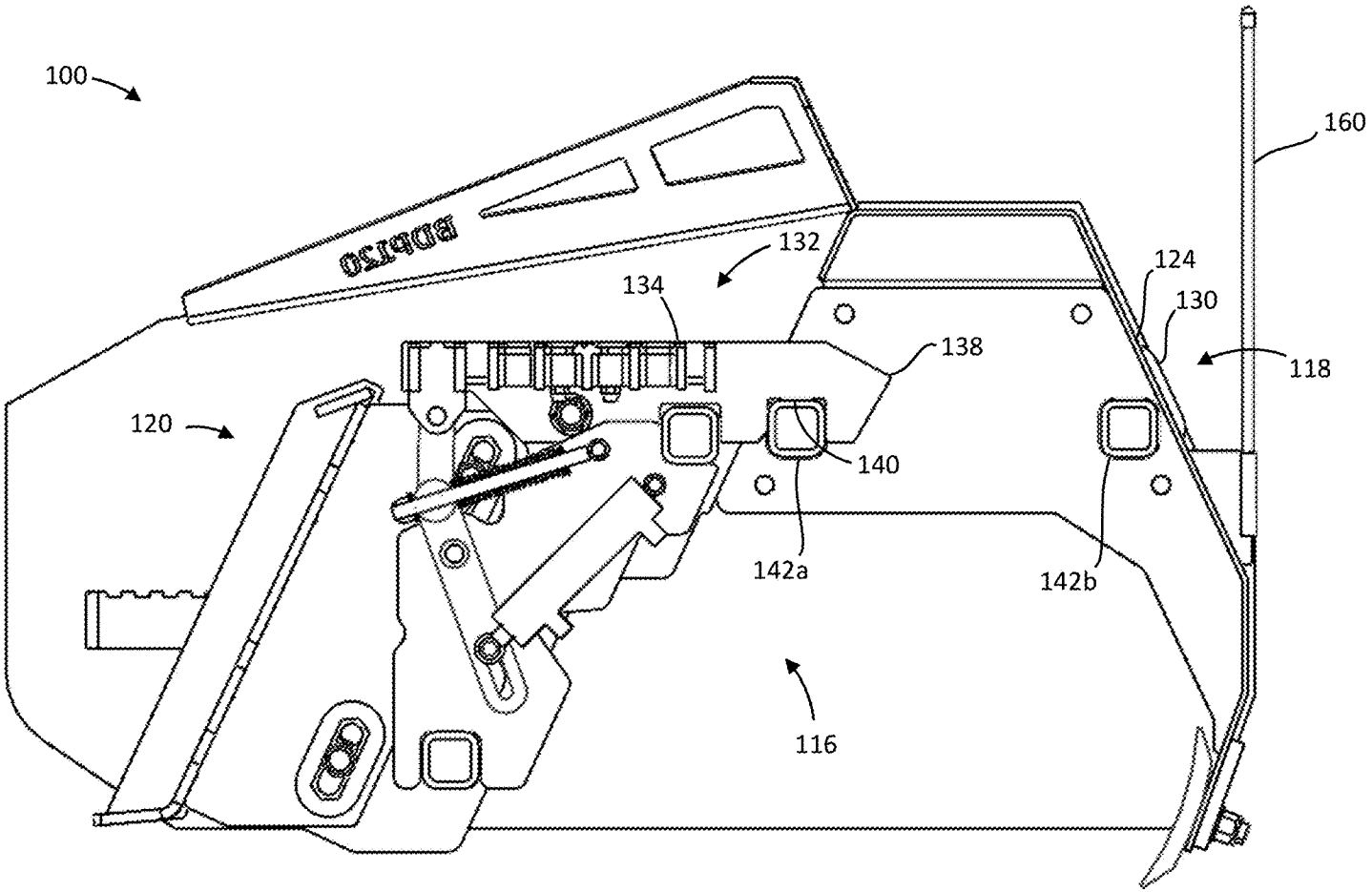
FIG. 10 is a cross-sectional view of the attachment of FIG. 6, taken along line 10-10 of FIG. 6.
Figure 11:
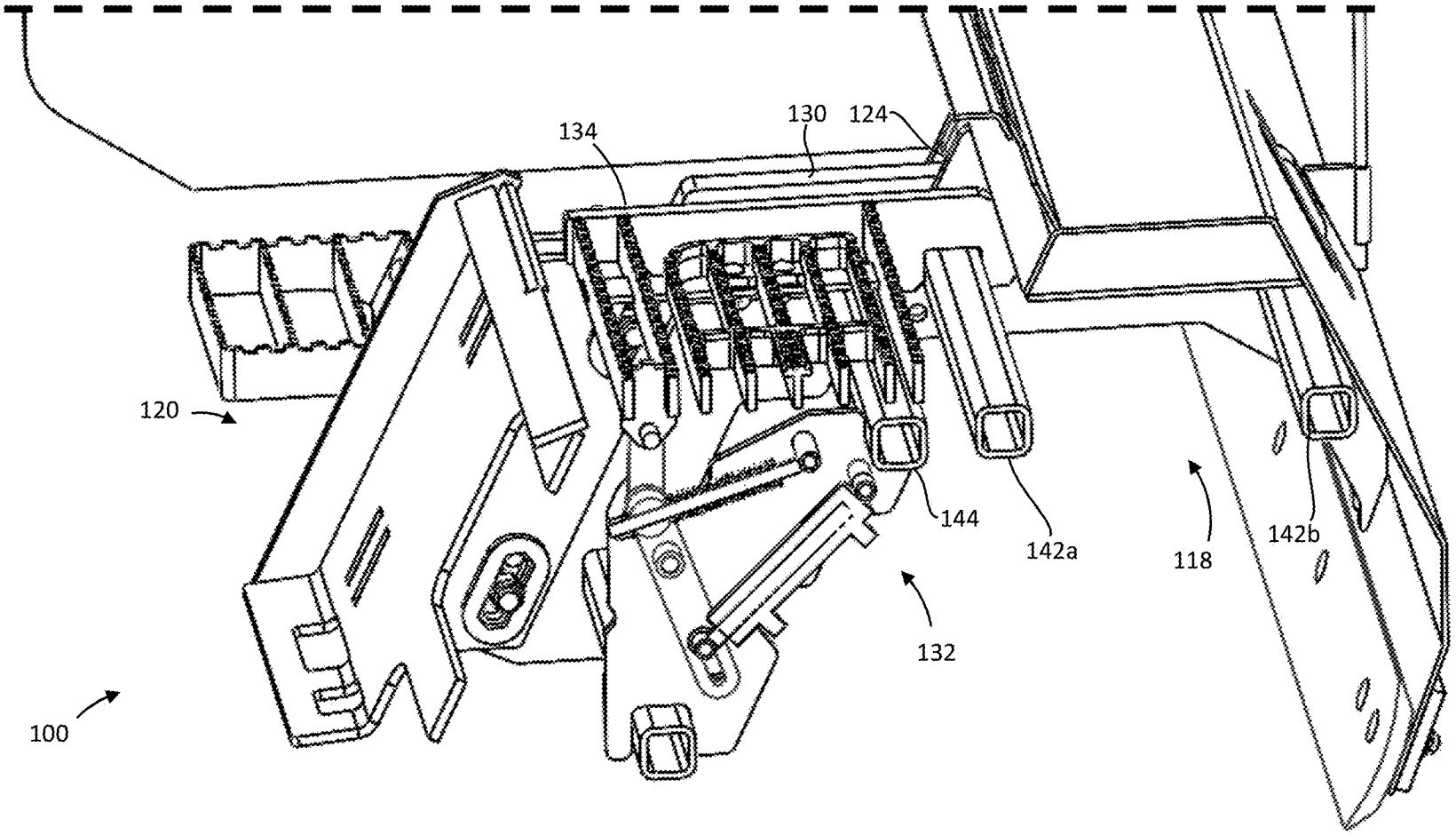
FIG. 11 is an enlarged perspective view of a portion of the attachment of FIG. 10.

Referring to FIG. 4, in the example illustrated, the abutment structure 136 comprises at least one retaining bar 142 extending in the lateral direction 108 (FIG. 1) and receivable in the notch 140 when the locking member 134 is in the locked position. In the example illustrated, the abutment structure 136 comprises a pair of the retaining bars 142, including a first retaining bar 142*a* positioned toward the front 106 of the blade 102 and a second retaining bar 142*b* spaced apart from the first retaining bar 142*a* along the coupling axis 122 toward the rear 107 of the blade 102. In the example illustrated, when the first and second coupling portions 118, 120 are interconnected in the pushing configuration and the locking member 134 is in the locked position, the locking notch 140 receives the second retaining bar 142*b* and is clear of the first retaining bar 142*a*. Referring to FIG. 10, when the first and second coupling portions 118, 120 are interconnected in the back-dragging configuration and the locking member 134 is in the locked position, the locking notch 140 receives the first retaining bar 142*a* and is clear of the second retaining bar 142*b*.

Referring to FIG. 5A, in the example illustrated, the second coupling portion 120 comprises an isolation bar 144 fixed to the frame 121 and extending parallel to the retaining bars 142. Each finger 138 of the locking member 134 has a corresponding force transfer notch 146 spaced apart from the locking notch 140. The force transfer notch 146 receives the isolation bar 144 when the locking member 134 is in the locked position. This can facilitate transfer of horizontal reaction forces from the first coupling portion 118 to the frame 121 of the second coupling portion 120 of the coupling mechanism 116 through the isolation bar 144, which can help isolate the pivot connection 135 of the locking member 134 from the horizontal reaction forces and corresponding moments during operation.

Still referring to FIG. 5A, in the example illustrated, the locking mechanism 132 includes an actuator assembly 150 mounted to the frame 121 of the second coupling portion 120 for moving the locking member 134 between the locked and unlocked positions. The actuator assembly 150 includes at least one actuator 152 energizable to urge movement of the locking member 134 between the locked and unlocked positions. In the example illustrated, the actuator assembly 150 further includes a return device 154 coupled to the locking member 134 for biasing the locking member 134 toward the locked position. In the example illustrated, the actuator 152 comprises a linear actuator in the form of a hydraulic cylinder 153 (a double acting hydraulic cylinder, in the example illustrated), and the return device 154 comprises a spring 155.

Referring to FIGS. 5A and 5B, in the example illustrated, the actuator 152 and the return device 154 are coupled to the locking member 134 through an actuator linkage 156 (a two-bar linkage, in the example illustrated) connected to the locking member frame 141 (FIG. 3). In the example illustrated, the linkage 156 has a linkage slot 157 slidably receiving a piston head 159 of the cylinder 153, which can compensate for use of standard hydraulic cylinder sizes in a compact space to achieve a desired motion profile for the linkage 156 and locking member 134. In the example illustrated, the spring 155 of the return device 154 exerts a biasing force on the linkage 156 for urging movement of the locking member 134 toward the locked position, and to facilitate controlled and predictable movement and positioning of the linkage 156 and the piston head 159 along the linkage slot 157. The actuator 152 is energizable in an unlocking direction (to urge piston extension in the example illustrated) to exert an unlocking force on the linkage 156 sufficient to overcome the biasing force exerted by the return device 154 and move the locking member 134 from the locked position to the unlocked position. In the example illustrated, the actuator 152 is energizable in a reverse locking direction (to urge piston retraction in the example illustrated) to exert a locking force on the linkage 156 that cooperates with the biasing force of the return device 154 to facilitate controlled movement of the locking member 134 to the locked position.

In the example illustrated, the actuator 152 is remotely operable, for example, from within a cab 16 (FIG. 2) of the vehicle 10. In the example illustrated, the actuator 152 is operable through an actuator control unit for controlling a power unit (e.g. a hydraulic and/or electrical power unit) to energize the actuator 152. In the example illustrated, the vehicle 10 comprises the actuator control unit and the power unit. The second coupling portion 120 of the coupling mechanism 116 includes one or more service connectors (e.g. hydraulic and/or electrical connectors) connectable to the power unit when the second coupling portion 120 is mounted to the vehicle to facilitate remote operation of the actuator 152 (and/or one or more other components of the attachment 100) through the actuator control unit.

Figure 9:
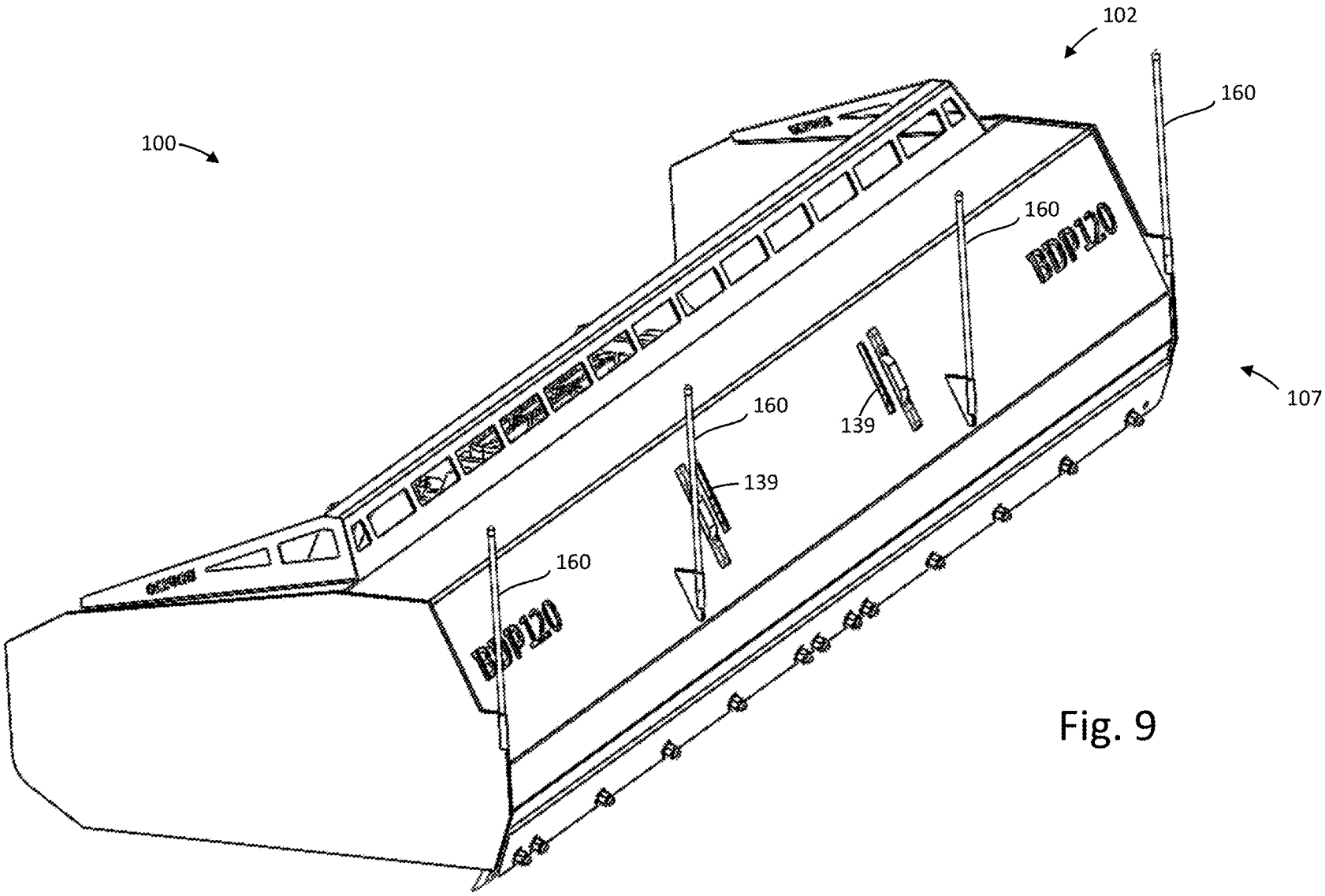
FIG. 9 is a rear perspective view of the attachment of FIG. 6.

Referring to FIG. 9, in the example illustrated, the attachment 100 includes a plurality of visual markers 160 attached adjacent the rear 107 of the blade 102 and projecting upwardly from the blade 102 to act as visual indicators of the position of the rear (and side) periphery of the blade 102. This can assist the operator in positioning the blade 102 and determining clearance during the back-dragging operation (e.g. to avoid contacting or damaging structure in the area being cleared by the blade 102).

Referring to FIGS. 1 and 2, in operation, the blade 102 is mounted to the vehicle 10 in the pushing configuration by driving the vehicle 10 forward parallel with the coupling axis 122 toward the rear 107 of the blade 102 with the first and second coupling portions 118, 120 in alignment with each other for interconnection. After interconnection, the first and second coupling portions 118, 120 are locked relative to each other. The vehicle 10 is then driven forward to push material with the working face 104 of the blade 102 to, for example, clear the ground surface of material (e.g. snow).

Referring also to FIGS. 6 and 7, when back-dragging is desired (e.g. to clear snow adjacent the structure 18), the blade 102 is released from the vehicle 10 and mounted in the back-dragging configuration. The blade 102 is released by unlocking the first and second coupling portions 118, 120 relative to each other and reversing the vehicle 10 away from the rear 107 of the blade 102 to disconnect the first and second coupling portions 118, 120. After the vehicle 10 and the second coupling portion 120 are clear of the blade 102 and the first coupling portion 118, the vehicle 10 is driven around to the front 106 of the blade 102 and driven forward parallel with the coupling axis 122 toward the front 106 of the blade 102 with the first and second coupling portions 118, 120 in alignment for interconnection in the back-dragging configuration. After interconnection, the first and second coupling portions 118, 120 are locked relative to each other.

The blade 102 is then moved into position for the back-dragging operation, which includes lifting the blade 102 to an elevation above the material to be cleared, moving the blade 102 toward the desired location, and lowering the blade 102 toward the ground surface 14 to capture the material between the blade working face 104 and the vehicle 10. The vehicle 10 is then operated in reverse to back-drag the material with the working face 104 of the blade 102.

In some cases, it may be desirable to use the same blade 102 as a box scraper for scraping and/or leveling the ground surface. To do so, the blade 102 is mounted to the same or a different vehicle in a towing configuration, like that shown in FIG. 12 for the blade 1102. In the towing configuration, the blade is behind the vehicle with the working face of the blade directed toward the vehicle for dragging the blade along a ground surface during forward operation. Use of the same blade for the pushing, back-dragging, and towing configurations can be desirable from both a manufacturing and customer perspective, for example, by not requiring manufacture and purchase of different blade designs for the different uses.

Figure 12:
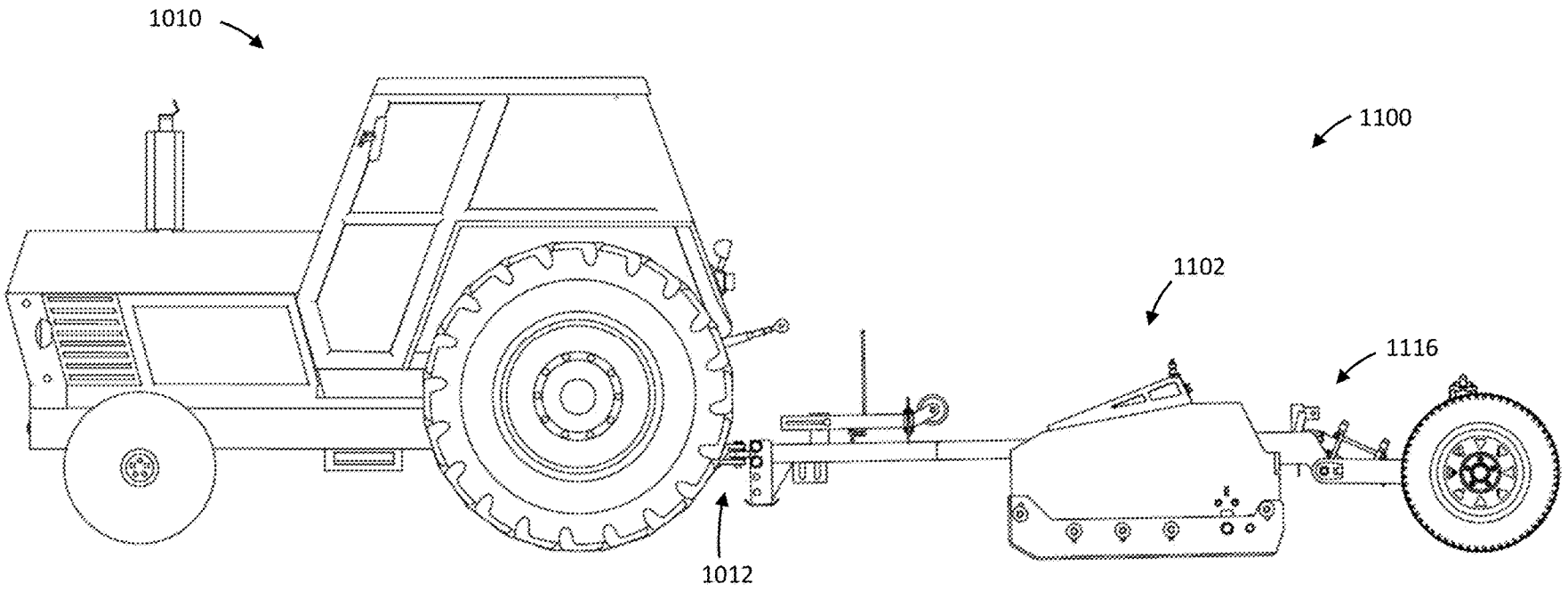
FIG. 12 is a side elevation view of another example material moving attachment, shown attached to another vehicle in a towing configuration.

Referring to FIG. 12, an example of another reconfigurable material moving attachment 1100 for a vehicle 1010 is illustrated. The attachment 1100 has similarities to the attachment 100 and like features are identified with like reference characters, incremented by 1000.

Figure 13:
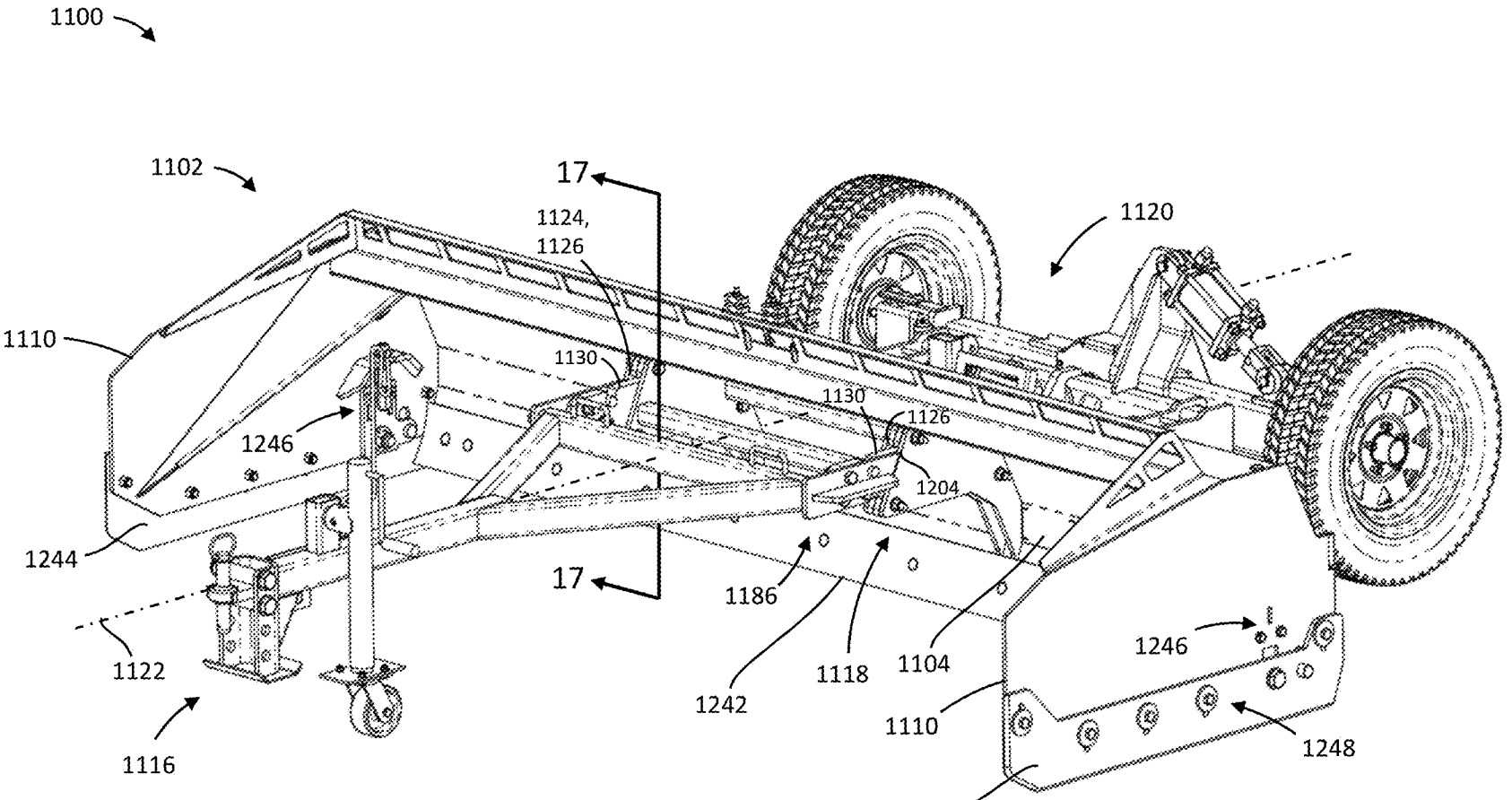
FIG. 13 is a front perspective view of the attachment of FIG. 12.

Referring to FIG. 13, in the example illustrated, the attachment 1100 includes a box blade 1102 similar to, and interchangeable with, the blade 102. The blade 1102 has a blade working face 1104 extending laterally between a pair of opposed side plates 1110. The attachment 1100 further includes a coupling mechanism 1116 for attaching the blade 1102 to the vehicle 1010. In the example illustrated, the coupling mechanism 1116 has a first coupling portion 1118 fixed to the blade 1102 and a second coupling portion 1120 attachable to the vehicle 1010. The second coupling portion 1120 is releasably interconnectable with the first coupling portion 1118 in a towing configuration, in which the blade working face 1104 is directed toward the vehicle 1010 (FIG. 12) for dragging the blade 1102 along a ground surface behind the vehicle 1010.

In the example illustrated, the first coupling portion 1118 is similar to, and interchangeable with, the first coupling portion 118. The first coupling portion 1118 has at least one coupling channel 1124 extending along a coupling axis 1122. In the example illustrated, the first coupling portion 1118 includes a pair of the coupling channels 1124 spaced laterally apart from each other by a channel spacing. Each coupling channel 1124 extends between a channel front end 1126 open to a front of the blade 1102 and a channel rear end 1128 (FIG. 14) axially opposite the channel front end 1126 and open to a rear of the blade 1102.

Figure 14:
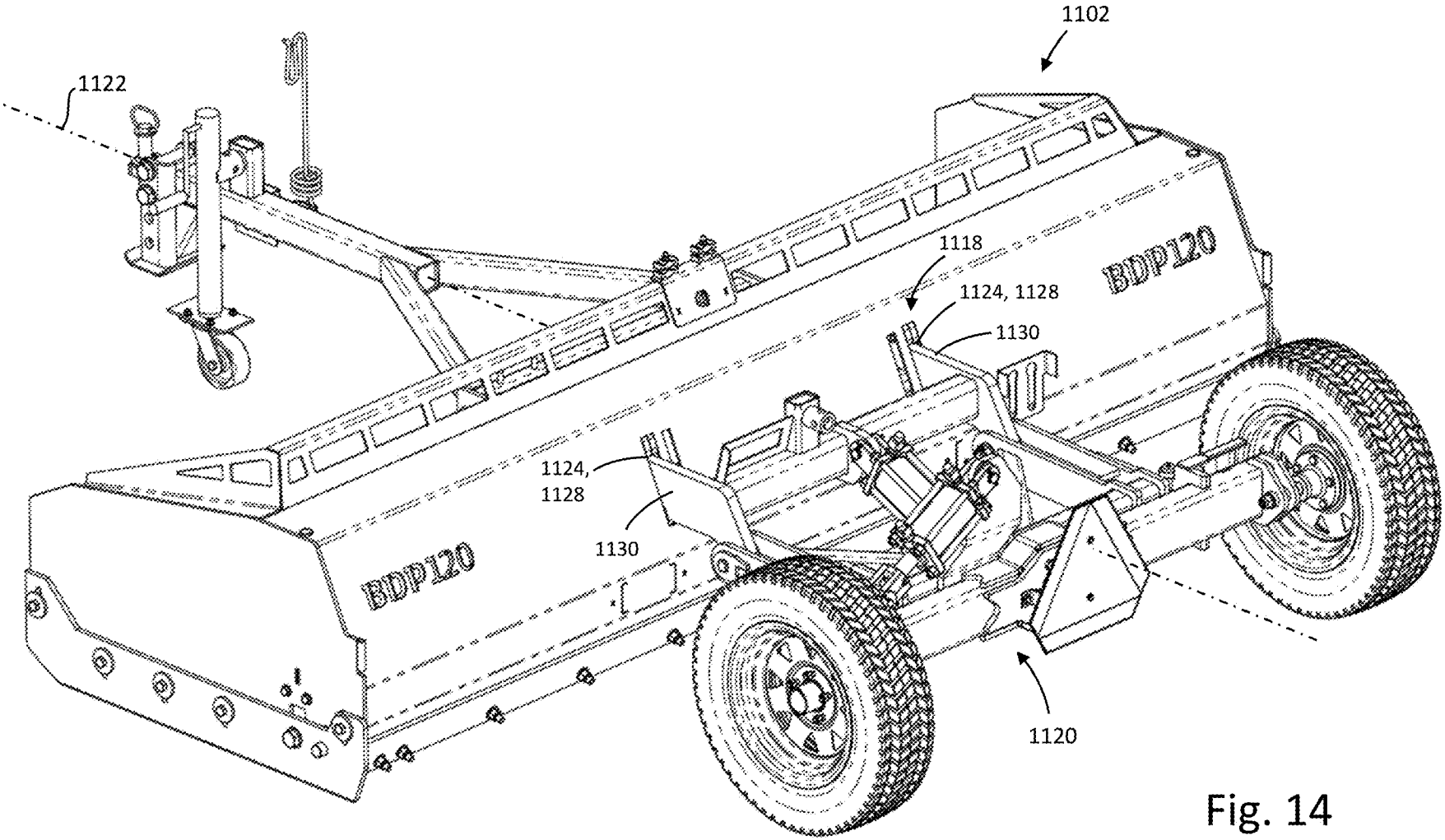
FIG. 14 is a rear perspective view of the attachment of FIG. 12.

Referring to FIG. 14, in the example illustrated, the second coupling portion 1120 has at least one arm 1130 alignable parallel with the coupling axis 1122. In the example illustrated, the second coupling portion 1120 comprises a pair of the arms 1130. The arms 1130 are spaced laterally apart from each other by an arm spacing corresponding to the channel spacing for lateral alignment of the arms 1130 with respective coupling channels 1124. The arms 1130 are slidably receivable in respective coupling channels 1124 to releasably interconnect the first and second coupling portions 1118, 1120 for attachment of the blade 1102 to the vehicle 1010.

Figure 15:
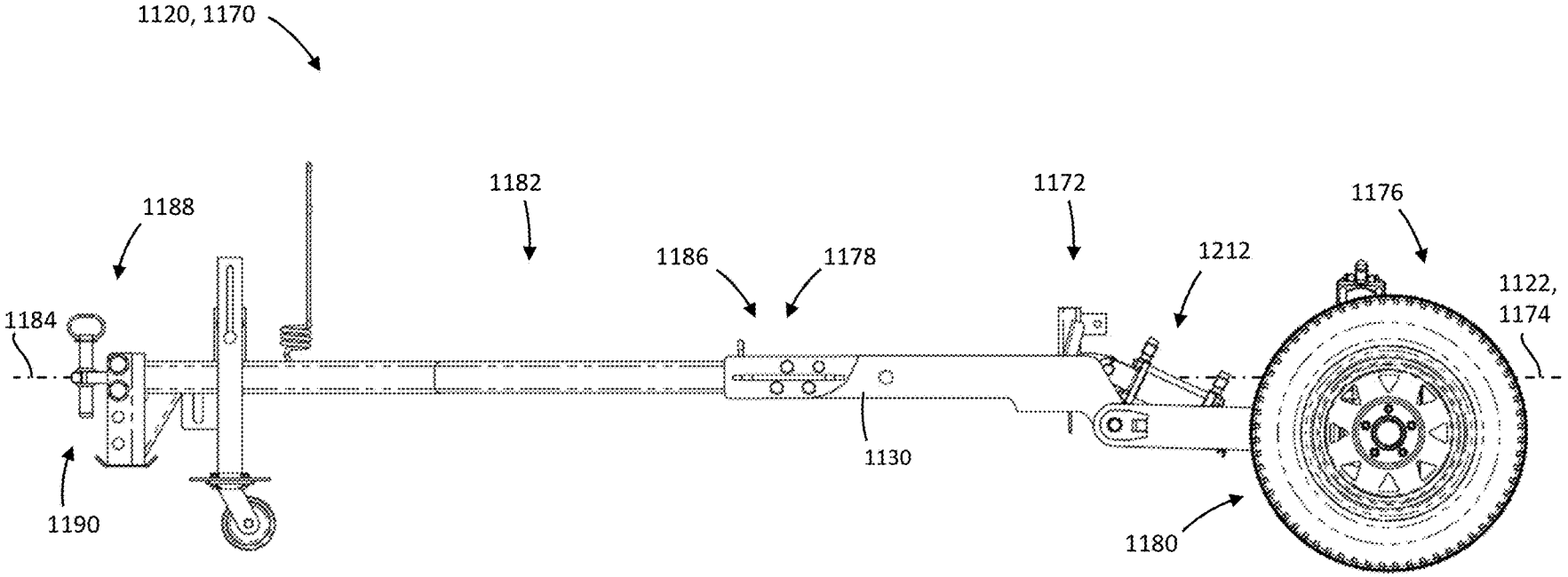
FIG. 15 is a side elevation view of a trailer assembly of the attachment of FIG. 12, showing a tongue frame of the trailer assembly in an operating position.

Referring to FIG. 15, in the example illustrated, the second coupling portion 1120 comprises a trailer assembly 1170 for attaching the blade 1102 behind the vehicle 1010 in the towing configuration. In the example illustrated, the trailer assembly 1170 includes a trailer frame 1172 extending along a trailer frame axis 1174 between a trailer frame rear end 1176 and a trailer frame front end 1178 axially opposite the trailer frame rear end 1176. In the example illustrated, the trailer frame axis 1174 extends parallel with the coupling axis 1122. The trailer frame rear end 1176 is supported above the ground surface by a plurality of wheel assemblies 1180. The trailer frame front end 1178 includes the pair of arms 1130, which project forward of the wheel assemblies 1180 along the trailer frame axis 1174.

In the example illustrated, the trailer assembly 1170 further includes a tongue frame 1182 extending along a tongue frame axis 1184 between a tongue frame rear end 1186 and a tongue frame front end 1188 axially opposite the tongue frame rear end 1186. In the example illustrated, the tongue frame axis 1184 extends parallel with the trailer frame and coupling axes 1122, 1174. The tongue frame front end 1188 has a hitch coupler 1190 for connection to a hitch 1012 (FIG. 12) of the vehicle 1010. The tongue frame rear end 1186 is attachable to the arms 1130 of the trailer frame 1172 for attaching the trailer frame 1172 to the vehicle 1010. The tongue frame rear end 1186 is detachable from the pair of arms 1130 to permit sliding of the box blade 1102 on to and off from the arms 1130. Referring to FIG. 13, in the example illustrated, when the arms 1130 are received in respective coupling channels 1124, a distal end of each arm 1130 projects forward out from the channel front end 1126 of a respective coupling channel 1124 for interconnection with the tongue frame rear end 1186.

Figure 16:
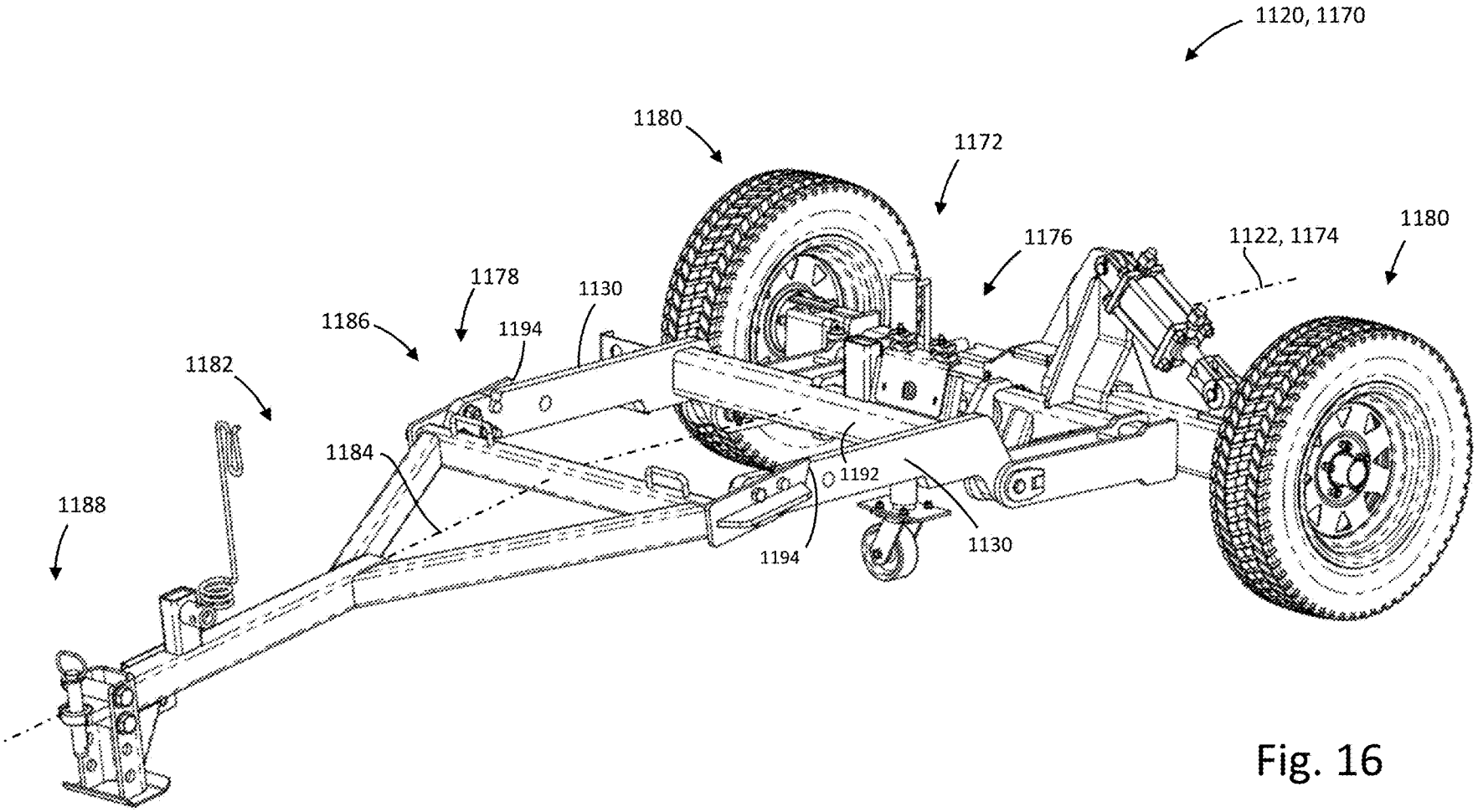
FIG. 16 is a front perspective view of the trailer assembly of FIG. 15, showing the tongue frame in an initial coupling position.

Referring to FIG. 16, in the example illustrated, when the tongue frame rear end 1186 is attached to the arms 1130 with the box blade 1102 (FIG. 13) mounted, the box blade 1102 is held axially captive between at least one first abutment surface 1192 and a second abutment surface 1194 spaced axially apart and directed toward the first abutment surface 1192. In the example illustrated, the first abutment surface 1192 is fixed to the trailer frame 1172 behind the blade working face 1104 and the second abutment surface 1194 is fixed to the tongue frame 1182 ahead of the blade working face 1104.

Figure 17:
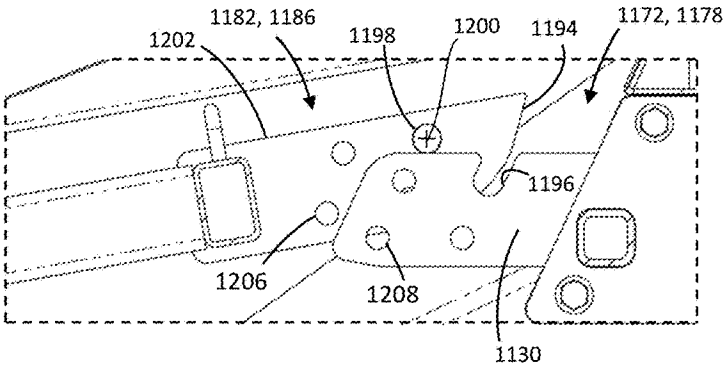
FIG. 17 is a side cross-sectional view of a portion of the attachment of FIG. 13 taken along line 17-17, showing the tongue frame prior to connection with a trailer frame of the trailer assembly.

Referring to FIG. 17, in the example illustrated, the distal end of each arm 1130 includes a slot 1196 open upwardly to a top of the arm 1130. The tongue frame rear end 1186 includes a pair of pins 1198 extending laterally along a pin axis 1200 and receivable in respective slots 1196 to connect the tongue frame 1182 to the trailer frame 1172. In the example illustrated, the tongue frame rear end 1186 has a pair of connector plates 1202 spaced laterally apart from each other. Each connector plate 1202 is positionable beside a respective arm 1130 and has a respective pin 1198 projecting laterally therefrom for inserting into a respective slot 1196. Each connector plate 1202 has a rear peripheral edge defining the second abutment surface 1194.

Figure 18:
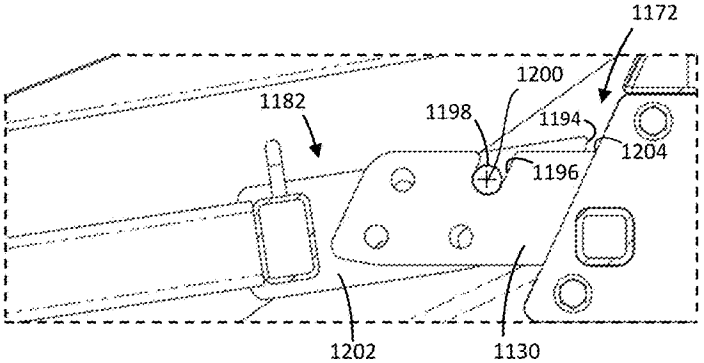
FIG. 18 is cross-sectional view like that of FIG. 17, showing the tongue frame connected to the trailer frame in the initial coupling position.
Figure 19:
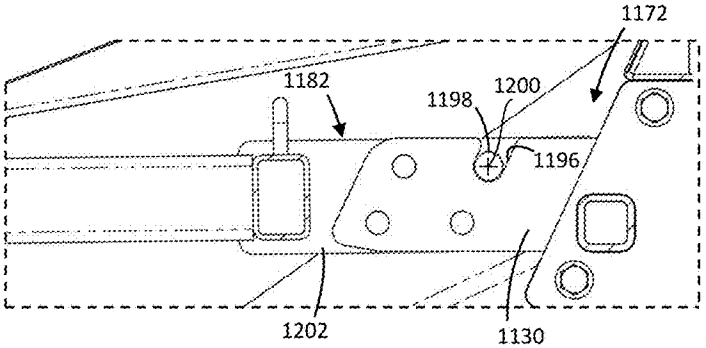
FIG. 19 is a side view like that of FIG. 17, showing the tongue frame connected to the trailer frame in the operating position.

Referring to FIG. 18, when each pin 1198 is received in a respective slot 1196, the tongue frame 1182 is pivotable about the pin axis 1200 relative to the trailer frame 1172, between an initial coupling position (shown in FIGS. 16 and 18) and an operating position (shown in FIGS. 15 and 19). Referring to FIG. 16, when in the initial coupling position, the tongue frame axis 1184 slopes downwardly from the tongue frame rear end 1186 toward the tongue frame front end 1188 relative to the trailer frame axis 1174. Referring to FIG. 15, when in the operating position, the tongue frame axis 1184 extends generally parallel with the trailer frame axis 1174 (and the coupling axis 1122).

Referring to FIG. 18, when in the initial coupling position, the second abutment surface 1194 is spaced axially forward of a front engagement surface 1204 fixed relative to the box blade 1102 to permit interference-free sliding of the pin 1198 into and out from the slot 1196. In the example illustrated, the first coupling portion 1118 comprises the front engagement surface 1204. When in the operating position, the second abutment surface 1194 is moved rearwardly relative to the initial coupling position for engagement with the front engagement surface 1204 of the box blade 1102 to retain the box blade 1102 in position between the first and second abutment surfaces 1192, 1194 (see also FIG. 13). In the example illustrated, the second abutment surface 1194 has a cammed curvature for gradually engaging the front engagement surface 1204 of the box blade 1102 during pivoting of the tongue frame 1182 from the initial coupling position toward the operating position. This can help gradually push the box blade 1102 rearwardly toward the first abutment surface 1192 and into position on the arms 1130 (if not already fully seated on the arms 1130).

Referring to FIG. 17, in the example illustrated, the tongue frame rear end 1186 has a plurality of tongue frame apertures 1206 extending therethrough parallel with and adjacent the pin axis 1200. In the example illustrated, the tongue frame apertures 1206 extend through the connector plates 1202. Each arm 1130 includes a plurality of corresponding arm apertures 1208 extending through the arm 1130 parallel with the pin axis 1200. Each tongue frame aperture 1206 is brought into alignment with a respective arm aperture 1208 when the tongue frame 1182 is moved into the operating position for receiving a respective fastener to secure the tongue frame 1182 to the trailer frame 1172 in the operating position.

Figure 20:
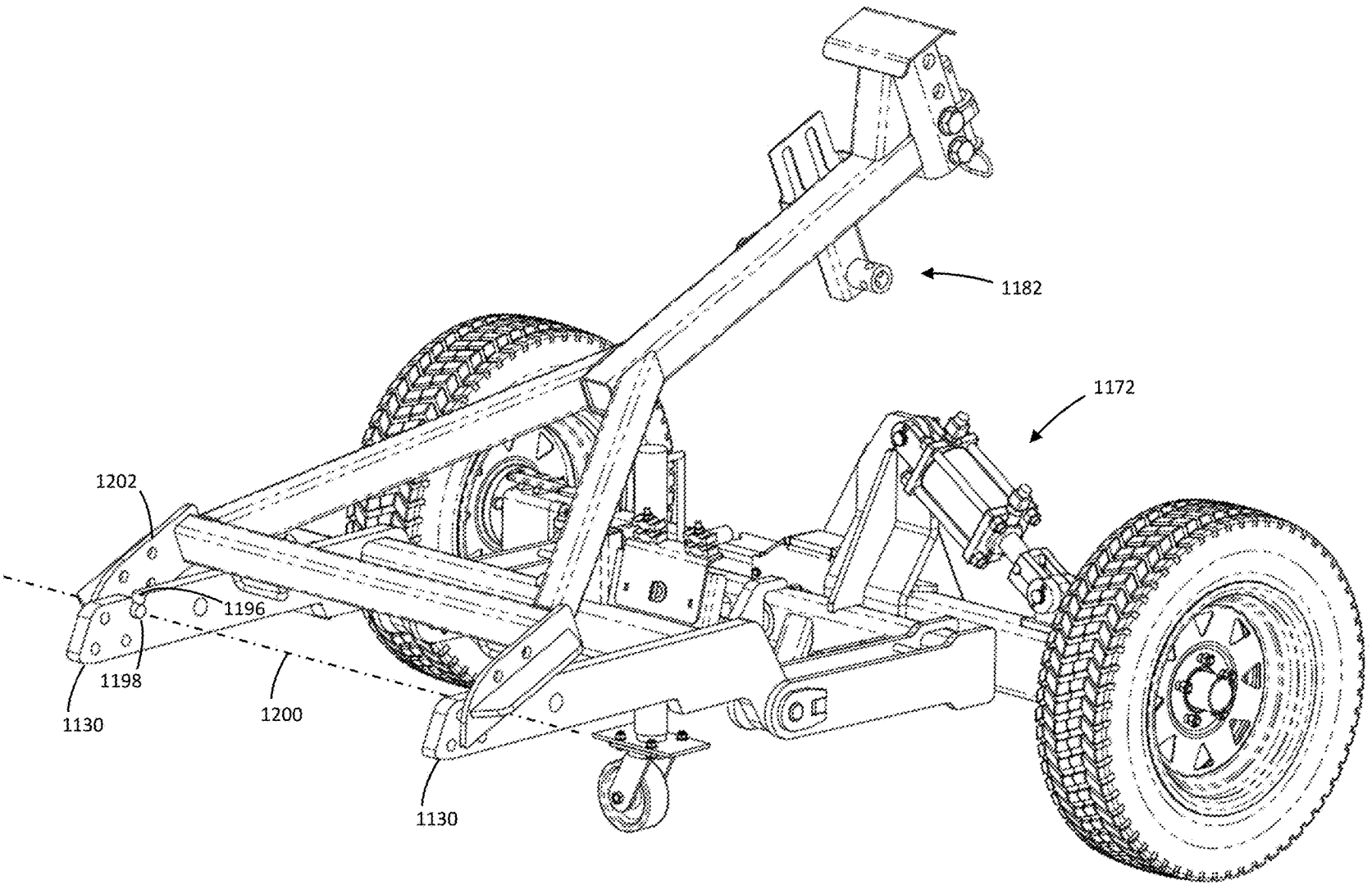
FIG. 20 is a front perspective view of the trailer assembly of FIG. 15, showing the tongue frame in a storage position.

In the example illustrated, the tongue frame 1182 projects forward of the trailer frame 1172 when in the initial coupling position (FIG. 16) and when in the operating position (FIG. 15). Referring to FIG. 20, when the pins 1198 are received in respective slots 1196, the tongue frame 1182 is further pivotable relative to the trailer frame 1172 about the pin axis 1200 to a storage position. When in the storage position, the tongue frame 1182 extends overtop of the trailer frame 1172 to reduce a footprint of the trailer assembly 1170 when not in use.

Figure 21:
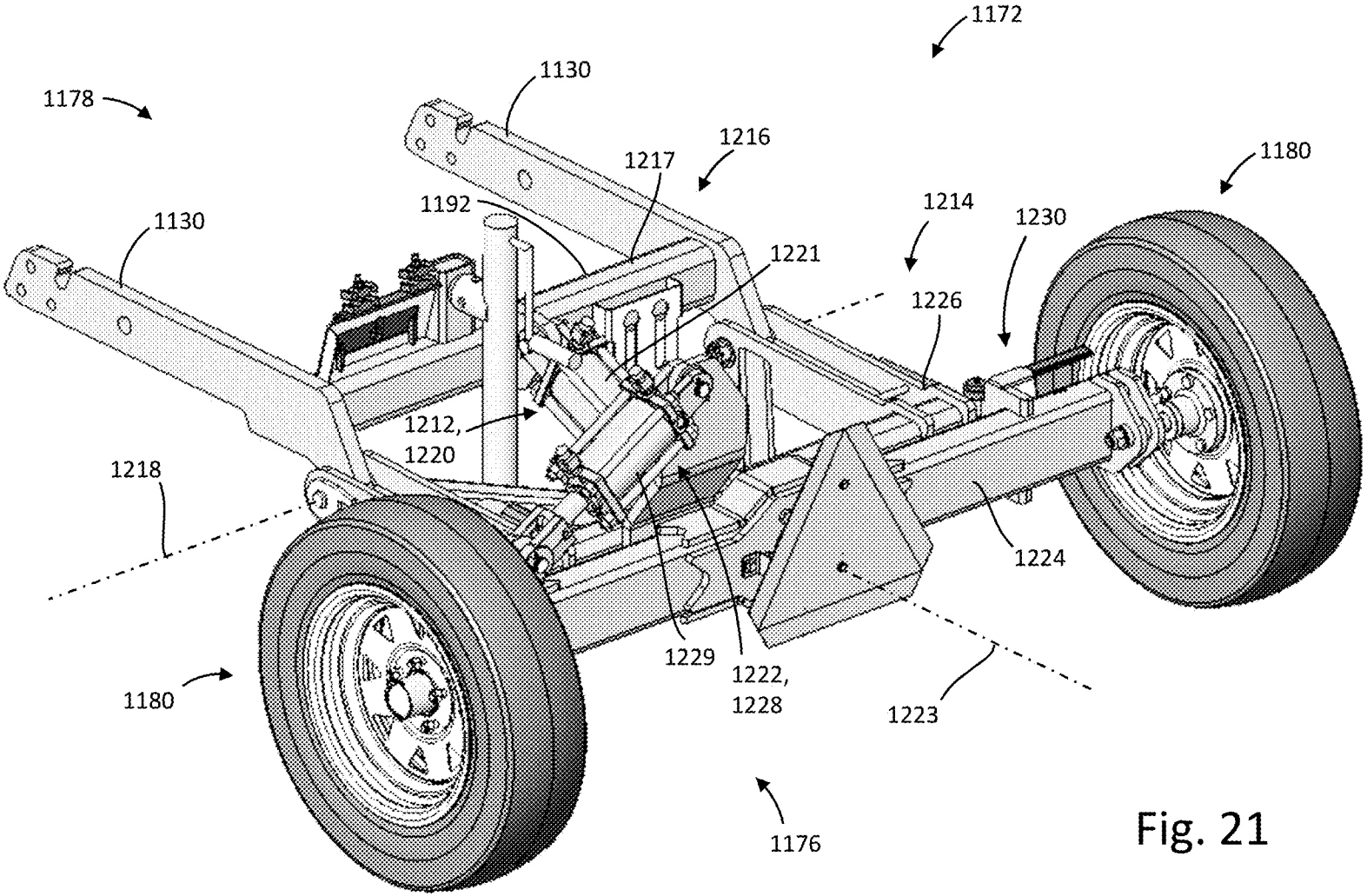
FIG. 21 is a rear perspective view of the trailer frame of the trailer assembly of FIG. 15.

Referring to FIG. 15, in the example illustrated, the trailer frame 1172 has a height adjustment mechanism 1212 operable to raise and lower the pair of arms 1130 relative to the wheel assemblies 1180 for adjusting elevation of the box blade 1102 relative to the ground surface. Referring to FIG. 21, in the example illustrated, the trailer frame 1172 has a frame body 1214 at the rear end 1176, and an arm frame 1216 at the front end 1178 and comprising the pair of arms 1130. In the example illustrated, the arm frame 1216 includes a cross-member 1217 extending laterally between and connecting the pair of arms 1130. The cross-member 1217 has a front surface directed toward the front end 1178 of the trailer frame 1172 and defining the first abutment surface 1192 for engagement with the rear of the blade 1102.

In the example illustrated, the arm frame 1216 has a proximal end axially opposite and rearward of the distal ends of the arms 1130. The proximal end is pivotably coupled to the frame body 1214 to permit pivoting of the pair of arms 1130 relative to the frame body 1214 about a lateral pivot axis 1218. The height adjustment mechanism 1212 includes at least one height-adjustment actuator 1220 coupled between the frame body 1214 and the arm frame 1216. The height-adjustment actuator 1220 is operable to urge pivoting of the arm frame 1216 relative to the frame body 1214 about the lateral pivot axis 1218 for adjusting elevation of the pair of arms 1130 (and the box blade 1102 when mounted) relative to the ground surface. The height-adjustment actuator 1220 comprises a hydraulic cylinder 1221 in the example illustrated.

In the example illustrated, the trailer frame 1172 has a tilt-adjustment mechanism 1222 operable to pivot the pair of arms 1130 about a tilt axis 1223 relative to the wheel assemblies 1180 to adjust a tilt of the box blade 1102 relative to the ground surface. In the example illustrated, the tilt axis 1223 extends generally parallel with the trailer frame axis 1174 (FIG. 16). In the example illustrated, the frame body 1214 has an axle portion 1224 extending laterally between opposed ends to which a pair of the wheel assemblies 1180 are mounted. The frame body 1214 further includes an intermediate portion 1226 axially between and connecting the axle portion 1224 and the arm frame 1216. A rear of the intermediate portion 1226 is pivotably coupled to the axle portion 1224 for pivoting of the intermediate portion 1226 relative to the axle portion 1224 about the tilt axis 1223. In the example illustrated, the arm frame 1216 is pivotably coupled to a front of the intermediate portion 1226 for pivoting about the lateral pivot axis 1218 relative to the frame body 1214, and the arm frame 1216 is fixed to pivot with the intermediate portion 1226 about the tilt axis 1223. The tilt-adjustment mechanism 1222 includes at least one tilt-adjustment actuator 1228 coupled between the axle portion 1224 and the intermediate portion 1226 of the frame body 1214. The tilt-adjustment actuator 1228 is operable to urge pivoting of the intermediate portion 1226 about the tilt axis 1223 relative to the axle portion 1224 for adjusting tilt of the pair of arms 1130 (and box blade 1102 when mounted) relative to the ground surface. The tilt-adjustment actuator 1228 comprises a hydraulic cylinder 1229 in the example illustrated.

Figure 22:
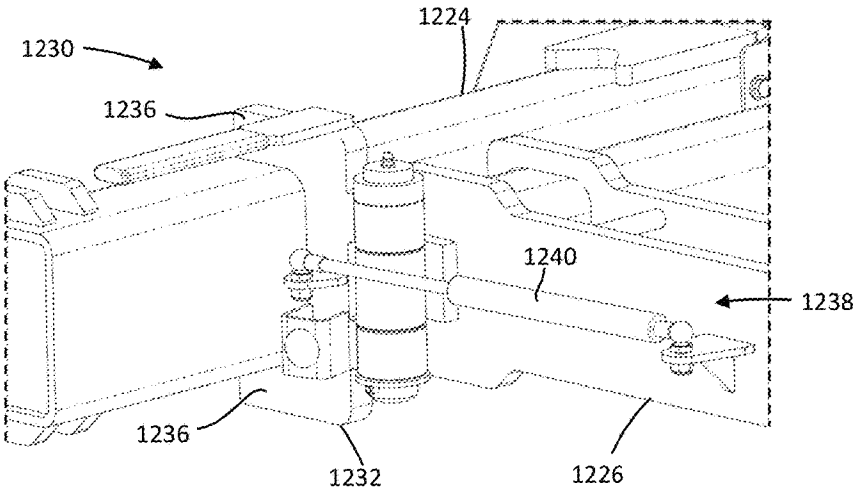
FIG. 22 is a front perspective view of a portion of the trailer frame of FIG. 21, showing a tilt lock mechanism in a locked configuration.
Figure 23:
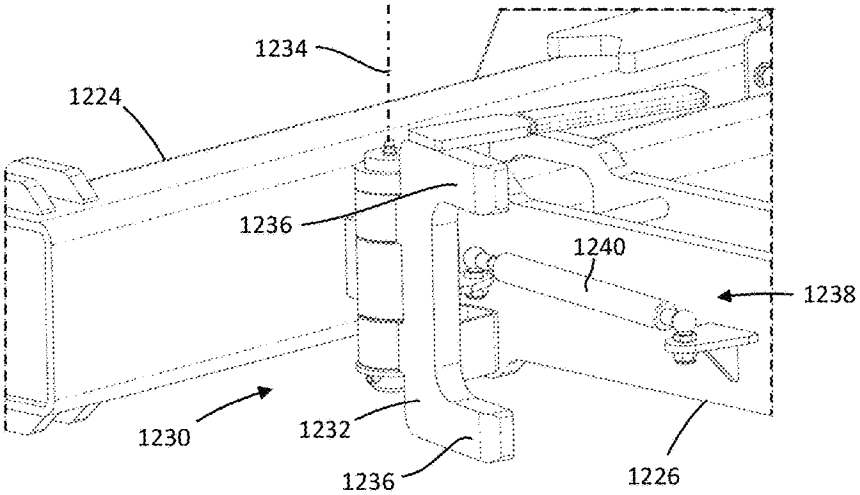
FIG. 23 is a front perspective view like that of FIG. 22, showing the tilt lock mechanism in an unlocked configuration.

In the example illustrated, the trailer frame 1172 has a tilt lock mechanism 1230 for selectively locking and unlocking the intermediate portion 1226 relative to the axle portion 1224 to inhibit and permit, respectively, tilting of the arms 1130. Referring to FIGS. 22 and 23, in the example illustrated, the tilt lock mechanism 1230 includes a lock member 1232 movably mounted to the intermediate portion 1226 for movement between a locked position (FIG. 22) and an unlocked position (FIG. 23). Referring to FIG. 22, when in the locked position, the lock member 1232 is positioned for engagement with the axle portion 1224 to lock and inhibit tilting of the intermediate portion 1226 relative to the axle portion 1224. Referring to FIG. 23, when in the unlocked position, the lock member 1232 is clear of the axle portion 1224 to permit tilting of the intermediate portion 1226 (and arms 1130) relative to the axle portion 1224. In the example illustrated, the lock member 1232 is spaced transversely from the tilt axis 1223 (FIG. 21), and is pivotably coupled to the intermediate portion 1226 for pivoting about a generally vertical axis 1234 between the locked and unlocked positions. The lock member 1232 includes a pair of fingers 1236 spaced vertically apart from each other. The axle portion 1224 is received vertically between the fingers 1236 when the lock member 1232 is in the locked position to lock the axle portion 1224 relative to the intermediate portion 1226. The fingers 1236 are clear of the axle portion 1224 when the lock member 1232 is in the unlocked position.

In the example illustrated, the tilt lock mechanism 1230 includes an over-center linkage 1238 including a spring 1240 for urging pivoting of the lock member 1232 toward, and retaining the lock member 1232 in, a desired position. When the lock member 1232 is pivoted past an over-center position during movement from the unlocked position toward the locked position, the spring 1240 biases the lock member 1232 toward the locked position. When the lock member 1232 is pivoted past the over-center position during movement from the locked position toward the unlocked position, the spring 1240 biases the lock member 1232 toward the unlocked position.

Figure 26:
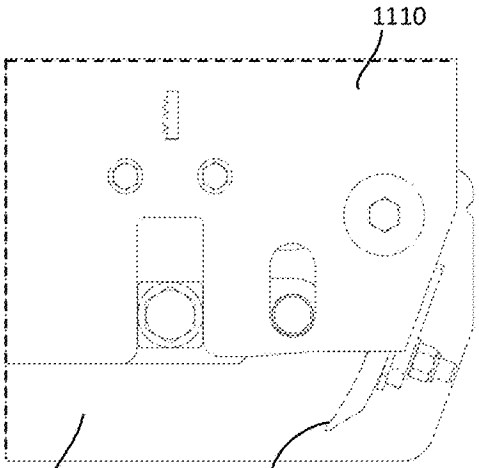
FIG. 26 is a side view like that of FIG. 25, showing the second side plate extension in a lowered position.
Figure 25:
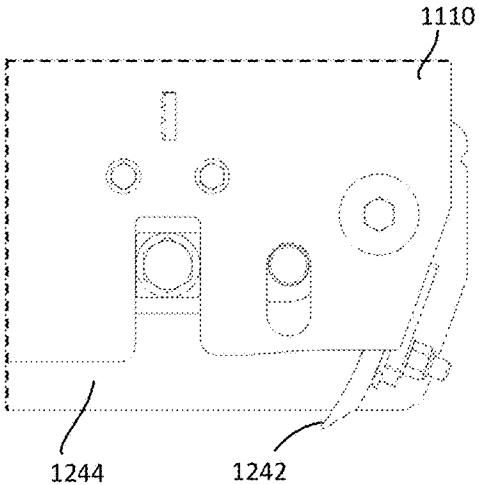
FIG. 25 is a side view of the blade portion of FIG. 24 with the first side plate extension removed, and showing an opposite second side plate extension in a raised position.

Referring to FIG. 13, in the example illustrated, the box blade 1102 has a cutting edge 1242 extending laterally along a lower edge of the blade working face 1104. The cutting edge 1242 is securely fixed relative to the blade working face 1104 and the side plates 1110, and is optionally replaceable (e.g. when worn down or when a different type of cutting edge—e.g. scarifier—is desired). In the example illustrated, a pair of side plate extensions 1244 are mounted against and project downwardly from respective side plates 1110 for engagement with the ground surface during operation. In the example illustrated, the box blade 1102 includes a side-plate height-adjustment mechanism 1246 on each side plate 1110 for raising and lowering a respective side plate extension 1244 relative to the cutting edge 1242, to adjust the cutting action of the cutting edge 1242. For example, referring to FIG. 25, for more aggressive cutting action, the side plate extensions 1244 can be raised to an elevation above the cutting edge 1242 to expose the cutting edge 1242. Referring to FIG. 26, the side plate extensions 1244 can be lowered to an elevation below or flush with the cutting edge 1242 for moving looser materials or spreading gravel, for example.

Figure 24:
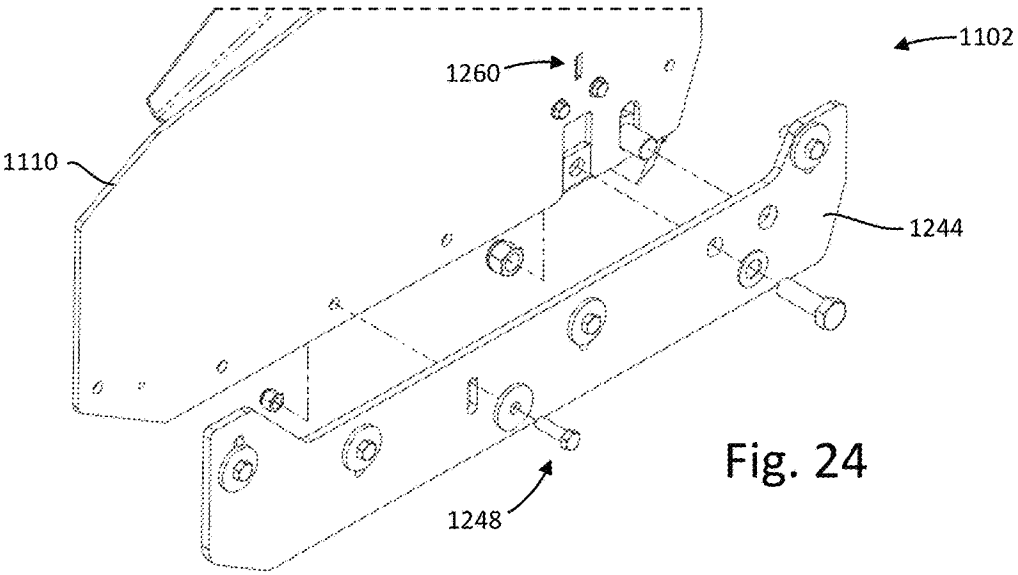
FIG. 24 is an exploded perspective view from an outboard side of a blade portion of the attachment of FIG. 12, showing a first side plate extension detached from a side plate of the blade portion.
Figure 27:
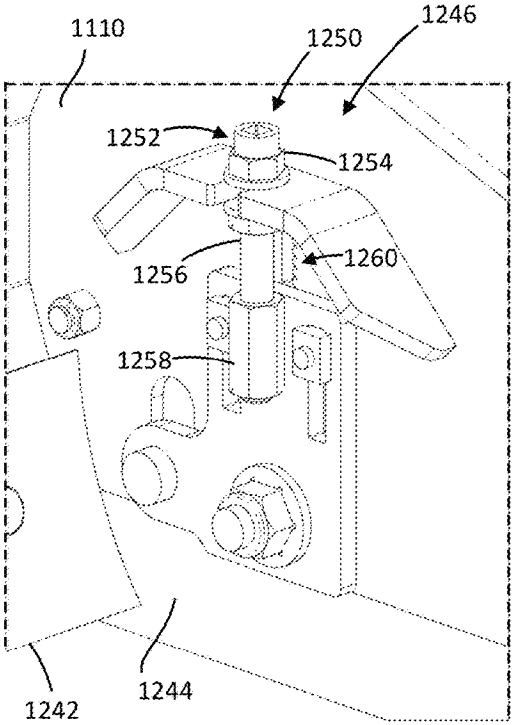
FIG. 27 is a perspective view from an inboard side of the blade portion of FIG. 24, showing a side-plate height-adjustment mechanism of the blade portion.

Referring to FIG. 24, in the example illustrated, each side plate extension 1244 is securable against a respective side plate 1110 by a plurality of fasteners 1248 (see also FIG. 13) passing laterally through the side plate extension 1244 and the side plate 1110. Referring to FIG. 27, each height-adjustment mechanism 1246 includes an actuator 1250 movably coupling the side plate extension 1244 and the side plate 1110. When the fasteners 1248 (FIG. 24) are loosened, the actuator 1250 is operable to translate the side plate extension 1244 vertically relative to the side plate 1110 (and cutting edge 1242). In the example illustrated, the actuator 1250 comprises a height-adjustment bolt 1252. The bolt 1252 is rotatably mounted to the side plate 1110 for rotation about a vertical axis. The bolt 1252 extends along the vertical axis between a head 1254 fixed vertically relative to the side plate 1110 and a shaft 1256 extending downwardly from the head 1254 into threaded engagement with a nut 1258 fixed to the side plate extension 1244. When the fasteners 1248 (FIG. 24) are loosened, the bolt 1252 is rotatable relative to the side plate 1110 in a first direction (e.g. clockwise) to raise the side plate extension 1244 relative to the side plate 1110. The bolt 1252 is rotatable in an opposite, second direction (e.g. counter-clockwise) to lower the side plate extension 1244 relative to the side plate 1110. When the side plate extension 1244 is at a desired height, the fasteners 1248 can be tightened to secure the side plate extension 1244 relative to the side plate 1110 at the desired height. Referring to FIG. 24, in the example illustrated, the height-adjustment mechanism 1246 further includes a height gauge 1260 for visually indicating a height of a respective side plate extension 1244 relative to the side plate 1110. This can facilitate, for example, convenient measurement and setting of both side plate extensions 1244 at the same height relative to the cutting edge 1242.

To change use of the blade 1102 from the towing configuration to the pushing or back-dragging configurations, the blade 1102 is removed from the trailer assembly 1170 by disconnecting the tongue frame 1182 from the trailer frame 1172. The blade 1102 is then slid forward off the arms 1130 of the trailer frame 1172. The side plate extensions 1244 are optionally removed and replaced with skid shoes suitable for the desired pushing and/or back-dragging operations. The box blade 1102 is then mounted to the second coupling portion 120 described above with reference to FIGS. 1-11 in either the pushing or back-dragging configuration (e.g. by sliding the arms 130 of the second coupling portion 120 into the coupling channels 1124 from either (i) the channel rear end 1128 to mount the blade 1102 in the pushing configuration, or (ii) the channel front end 1126 to mount the blade 1102 in the back-dragging configuration).

What has been described above is intended to be illustrative of examples of the teaching disclosed herein, without limiting the scope of patent claims granted herefrom. The scope of such claims should be given the broadest interpretation consistent with the description as a whole.

The invention claimed is:

1. A reconfigurable material moving attachment for a vehicle, comprising:

a) a blade having a blade working face directed toward a front of the blade and extending in a lateral direction between opposed side plates, each side plate projecting forward of the blade working face, the side plates having inboard surfaces directed towards one another for laterally enclosing a material collection space adjacent the blade working face; and b) a coupling mechanism for attaching the blade to the vehicle, the coupling mechanism including:

i) a first coupling portion fixed to the blade and having at least one coupling channel extending along a coupling axis, the coupling axis generally parallel to a ground surface and orthogonal to the lateral direction, each coupling channel extending between a channel front end open to the front of the blade and a channel rear end axially opposite the channel front end and open to a rear of the blade, and ii) a second coupling portion attachable to the vehicle, the second coupling portion having at least one arm alignable parallel with the coupling axis and a vehicle mount opposite the at least one arm for mounting the second coupling portion to the vehicle with the at least one arm projecting away from the vehicle, each arm slidably receivable in a respective coupling channel to releasably interconnect the first and second coupling portions for attachment of the blade to the vehicle, and each arm slidably receivable into a respective coupling channel from: (i) the channel rear end to mount the blade to the vehicle in a forward pushing configuration, in which the blade working face is directed away from the vehicle for pushing material in the material collection space, and (ii) the channel front end to mount the blade to the vehicle in a back-dragging configuration, in which the blade working face is directed toward the vehicle for back-dragging material in the material collection space.

2. The attachment of claim 1, wherein the coupling mechanism comprises a locking mechanism for axially locking the first and second coupling portions relative to each other when interconnected.

3. The attachment of claim 2, wherein the locking mechanism includes a locking member moveably coupled to one of the first and second coupling portions, and when the first and second coupling portions are interconnected, the locking member is movable relative to an abutment structure fixed to the other one of the first and second coupling portions, between a locked position for interlocking engagement with the abutment structure to axially lock the first and second coupling portions relative to each other, and an unlocked position clear of the abutment structure.

4. The attachment of claim 3, wherein the locking member comprises at least one finger with a locking notch, and the abutment structure comprises at least one retaining bar extending in the lateral direction, wherein the locking notch is clear of the retaining bar when the locking member is in the unlocked position, and the locking notch receiving at least a portion of the retaining bar when the locking member is in the locked position.

5. The attachment of claim 3, wherein the at least one arm includes a pair of arms spaced laterally apart from each other, and the at least one coupling channel includes a pair of coupling channels for slidably receiving respective arms, and wherein the locking member is movably coupled to the second coupling portion laterally intermediate the pair of the arms, and the abutment structure is fixed to the first coupling portion laterally intermediate the pair of coupling channels.

6. The attachment of claim 3, wherein the locking mechanism includes at least one actuator energizable for urging movement of the locking member between the locked and unlocked positions.

7. The attachment of claim 6, wherein the locking mechanism includes a return device coupled to the locking member for biasing the locking member toward the locked position.

8. A reconfigurable material moving attachment for a vehicle, comprising:

a) a blade having a blade working face directed toward a front of the blade and extending in a lateral direction between opposed side plates, each side plate projecting forward of the blade working face, the side plates having inboard surfaces directed towards one another for laterally enclosing a material collection space adjacent the blade working face; and b) a coupling mechanism for attaching the blade to the vehicle, the coupling mechanism including:

i) a first coupling portion fixed to the blade and having at least one coupling channel extending along a coupling axis, the coupling axis generally parallel to a ground surface and orthogonal to the lateral direction, each coupling channel extending between a channel front end open to the front of the blade and a channel rear end axially opposite the channel front end and open to a rear of the blade, and ii) a second coupling portion attachable to the vehicle, the second coupling portion having at least one arm alignable parallel with the coupling axis, each arm slidably receivable in a respective coupling channel to releasably interconnect the first and second coupling portions for attachment of the blade to the vehicle, and iii) a locking mechanism for axially locking the first and second coupling portions relative to each other when interconnected, the locking mechanism including a locking member moveably coupled to the second coupling portion, and when the first and second coupling portions are interconnected, the locking member is movable relative to an abutment structure fixed to the first coupling portion, between a locked position for interlocking engagement with the abutment structure to axially lock the first and second coupling portions relative to each other, and an unlocked position clear of the abutment structure, the locking member comprising at least one finger with a locking notch, and the abutment structure comprising at least one retaining bar extending in the lateral direction, the locking notch clear of the retaining bar when the locking member is in the unlocked position, and the locking notch receiving at least a portion of the retaining bar when the locking member is in the locked position, wherein the second coupling portion comprises an isolation bar extending parallel to the at least one retaining bar, and the finger of the locking member comprises a force transfer notch spaced apart from the locking notch, the force transfer notch receiving the isolation bar when the locking member is in the locked position to facilitate transfer of horizontal reaction forces from the first coupling portion of the coupling mechanism to the second coupling portion through the isolation bar.

9. A reconfigurable material moving attachment for a vehicle, comprising:

a) a blade having a blade working face directed toward a front of the blade and extending in a lateral direction between opposed side plates, each side plate projecting forward of the blade working face, the side plates having inboard surfaces directed towards one another for laterally enclosing a material collection space adjacent the blade working face; and b) a coupling mechanism for attaching the blade to the vehicle, the coupling mechanism including:

i) a first coupling portion fixed to the blade and having at least one coupling channel extending along a coupling axis, the coupling axis generally parallel to a ground surface and orthogonal to the lateral direction, each coupling channel extending between a channel front end open to the front of the blade and a channel rear end axially opposite the channel front end and open to a rear of the blade, and ii) a second coupling portion attachable to the vehicle, the second coupling portion having at least one arm alignable parallel with the coupling axis, each arm slidably receivable in a respective coupling channel to releasably interconnect the first and second coupling portions for attachment of the blade to the vehicle, and the second coupling portion comprising a trailer frame for attaching the blade behind the vehicle in a towing configuration, in which the blade working face is directed toward the vehicle for dragging the blade along the ground surface behind the vehicle, wherein the trailer frame has a rear end supported above a ground surface by a plurality of wheel assemblies and the at least one arm projects forward of the wheel assemblies toward the vehicle, each arm slidably receivable into a respective coupling channel from the channel rear end to mount the blade in the towing configuration.

10. A box blade assembly for vehicles, comprising:

a) a box blade having a blade working face directed toward a front of the blade and extending in a lateral direction between opposed side plates, each side plate projecting forward of the blade working face, the side plates having inboard surfaces directed towards each other for laterally enclosing a material collection space adjacent the blade working face; and b) a first coupling portion fixed to the blade and having at least one coupling channel extending along a coupling axis between a channel front end open to the front of the blade and a channel rear end axially opposite the channel front end and open to a rear of the blade, the coupling axis generally parallel to a ground surface and orthogonal to the lateral direction, and the first coupling portion releasably interconnectable with a second coupling portion attachable to a vehicle, the second coupling portion having at least one arm alignable parallel with the coupling axis, each arm slidably receivable in a respective coupling channel to releasably interconnect the first and second coupling portions for attaching the box blade to the vehicle, each arm slidably receivable into a respective coupling channel from: (i) the channel rear end to mount the blade to the vehicle in a forward pushing configuration, in which the blade working face is directed away from the vehicle for pushing material in the material collection space, and (ii) the channel front end to mount the blade to the vehicle in a back-dragging configuration, in which the blade working face is directed toward the vehicle for back-dragging material in the material collection space; and c) an abutment structure fixed relative to the first coupling portion, the abutment structure interlockable with a locking member movably coupled to the second portion when each arm is slidably received in the respective coupling channel from the channel rear end to axially lock the first and second coupling portions relative to each other in the forward pushing configuration, and when each arm is slidably received in the respective coupling channel from the channel front end to axially lock the first and second coupling portions relative to each other in the back-dragging configuration.

11. The box blade assembly of claim 10, wherein the at least one coupling channel extends through the blade working face.

12. The box blade assembly of claim 10, wherein the at least one coupling channel includes a pair of coupling channels spaced laterally apart from each other for receiving respective arms of the second coupling portion.

13. The box blade assembly of claim 12, wherein the abutment structure includes at least one retaining bar extending in the lateral direction between and fixed to the pair of coupling channels for interlocking engagement with the locking member.

14. The box blade assembly of claim 10, wherein the abutment structure is within the material collection space.

15. The box blade assembly of claim 14, wherein at least one aperture extends through the blade along the coupling axis, each aperture for receiving a respective finger of the locking member for interlocking engagement with the abutment structure when each arm is received in a respective channel through the channel rear end for the forward pushing configuration.

16. The box blade assembly of claim 10, wherein the abutment structure includes a pair of retaining bars each extending in the lateral direction, the pair of retaining bars including a first retaining bar positioned toward the front of the blade and a second retaining bar spaced apart from the first retaining bar along the coupling axis toward a rear of the blade, the locking member interlockable with the first retaining bar and clear of the second retaining bar in the back-dragging configuration, and the locking member interlockable with the second retaining bar and clear of the first retaining bar in the pushing configuration.

17. A reconfigurable material moving attachment for a vehicle, comprising:

a) a blade having a blade working face; and b) a coupling mechanism for reversibly mounting the blade to a vehicle, the coupling mechanism including:

i) a first coupling portion fixed to the blade, ii) a second coupling portion mountable to the vehicle, the second coupling portion releasably interconnectable with the first coupling portion in a forward pushing configuration, in which the blade working face is directed away from the vehicle for pushing the material forward, and a back-dragging configuration, in which the blade working face is directed toward the vehicle for back dragging the material, and iii) a locking mechanism for axially locking the first and second coupling portions relative to each other when interconnected in the forward pushing configuration and in the back-dragging configuration, the locking mechanism including a locking member moveably coupled to one of the first and second coupling portions, and when the first and second coupling portions are interconnected in either of the pushing configuration and the back-dragging configuration, the locking member is movable relative to an abutment structure fixed to the other one of the first and second coupling portions, between a locked position for interlocking engagement with the abutment structure to axially lock the first and second coupling portions relative to each other and an unlocked position clear of the abutment structure, wherein the first coupling portion includes a pair of coupling channels and the second coupling portion includes a pair of arms spaced laterally apart from each other, each coupling channel for slidably receiving a respective arm from a first end of the channel to interconnect the first and second coupling portions in the pushing configuration and from a second end of the channel opposite the first end to interconnect the first and second coupling portions in the back-dragging configuration, and wherein the locking member is movably coupled to the second coupling portion laterally intermediate the pair of arms, and the abutment structure is fixed to the first coupling portion laterally intermediate the pair of coupling channels.

* * * * *